US006608263B2

(12) United States Patent
Myojin

(10) Patent No.: US 6,608,263 B2
(45) Date of Patent: Aug. 19, 2003

(54) SLIDE SWITCH

(75) Inventor: Satoshi Myojin, Tokyo (JP)

(73) Assignee: Mitsuku Denshi Kogyo K.K., Tokyo (JP)

( * ) Notice: Subject to any disclaimer, the term of this patent is extended or adjusted under 35 U.S.C. 154(b) by 0 days.

(21) Appl. No.: 10/161,962

(22) Filed: Jun. 3, 2002

(65) Prior Publication Data

US 2002/0195323 A1 Dec. 26, 2002

(51) Int. Cl.[7] ..... H01H 15/00
(52) U.S. Cl. ..... 200/16 D; 200/6 A
(58) Field of Search ..... 200/16 R, 16 C, 200/16 D, 1 B, 1 V, 16 F, 6 A, 547–550, 563

(56) References Cited

U.S. PATENT DOCUMENTS 4,531,027 A * 7/1985 Vogt et al. ..... 200/6 A
5,621,196 A * 4/1997 Nishijima et al. ..... 200/6 A
6,177,640 B1 * 1/2001 Okabe et al. ..... 200/6 A
6,441,753 B1 * 8/2002 Montgomery ..... 341/34

FOREIGN PATENT DOCUMENTS

JP 2001-93385 4/2001 ..... H01H/25/00

* cited by examiner

*Primary Examiner*—Elvin Enad
*Assistant Examiner*—Lisa Klaus
(74) *Attorney, Agent, or Firm*—Quales & Brady LLP

(57) ABSTRACT

A slide switch is provided wherein the slider can be universally slid smoothly with a small force and with high precision and accuracy. In the slide switch, to form a sliding bridge, two upper strips in parallel and two lower strips in parallel are integrally framed in a cross, square, or rectangular shape. The slider is mounted on the base in such a way that it can be slid freely and relatively in desired directions. Plural stationary contacts on the base are arranged oppositely to plural contacts of the movable contact spring piece of the slider. When the slider moves in a desired direction from its center and returns toward the center, the contacts of the movable contact spring piece are connected or disconnected to/from the stationary contacts of the base.

17 Claims, 29 Drawing Sheets

CENTER PUSH CIRCUIT CONFIGURATION

CIRCUIT CONFIGURATION IN SLIDE OPERATION

SLIDE SWITCH

CROSS REFERENCES TO RELATED APPLICATIONS

This application claims priority under 35 U.S.C. 119 (a)–(d) or (f), 365(b) to Japanese Patent Application No. 2001-167568 filed on Jun. 4, 2001 and Japanese Patent Application No. 2001-284314 filed on Sep. 19, 2001.

STATEMENT REGARDING FEDERALLY SPONSORED RESEARCH

Not Applicable.

BACKGROUND OF THE INVENTION

The present invention relates to a slide switch.

Conventionally, a wide variety of slide switches exist, which include a slider with movable contacts and a base or case with stationary contacts. In such a slide switch, when the movable contacts are connected or disconnected to/from the stationary contacts, a switching function, a mode switching function, and other electrical functions are performed For example, a conventional switch in which, the slider is movable in four directions (vertically and horizontally) to perform its switching function requires a large number of components. A conventional switch of this type, which is miniaturized (e.g. a switch of 15 mm in length×15 mm in width×3 to 5 mm in thick), is very difficult to assemble, leading to increased costs. This also results in the problem that uniform and high precision performance cannot be obtained.

Furthermore, because space in the switch is limited, the slider is movable only in the four directions (in the X-axis and Y-axis directions or horizontally and vertically. However, there is a need to provide means that can allow the slider to move in four or more directions (e.g. in 6, 8, 12, or 16 directions) with high precision. Moreover, it is desirable that the slider can be accurately moved in a desired direction by a small force.

SUMMARY OF THE INVENTION

The present invention addresses the above mentioned problems.

An object of the invention is to provide an improved slide switch where the slider can universally move over the base in the two-dimensional plane.

A further object of the present invention is to provide a slide switch where the slider can slide smoothly and lightly in a desired direction without any torsion, backlash, or rotational deviation.

According to an aspect of the present invention, the slide switch; comprises a base, including plurality of patterned spaces, on which one or more stationary contacts of an arbitrary shape are provided; a slider mounted on said base, a movable contact spring piece including a plurality of contact spring pieces with contacts thereon. The slider comprises; two upper sliding bridges, arranged in parallel and fitted into two guide grooves arranged in parallel on the base. The two lower sliding bridges, arranged in parallel, are fitted into two guide grooves arranged in parallel on the slider, whereby the slider is free to move in a desired direction. When each of the movable contacts of a movable contact spring piece of the slider are moved in a desired direction, they are connected or disconnected to/from a target stationary contact. As such, a switching function, a mode switching function, or an electrical function is performed, where one or more movable contacts and one or more stationary contacts are connected or disconnected.

According to another aspect of the present invention, the slide switch comprises; a base having a plurality of patterned spaces of arbitrary shape, in which a stationary contact is formed around a center point on a surface of a patterned space. At least one stationary contact of an arbitrary patterned circuit being exposed and formed on each of the patterned spaces. Furthermore, a terminal for at least one stationary contact protrudes out from the base, whereby two guide grooves of a set length are arranged in parallel on the surface and formed in the X or Y axis direction so as to be symmetric about the center point. The slider further comprises an operable portion being the upper surface of an arbitrarily shaped plate, the slider having a slider body on which two guide grooves of a set length arranged in parallel in the lower surface and formed in parallel in the Y or X axis direction so as to be symmetric about the center point on the lower surface. Moreover the slider includes a movable contact spring piece with a plurality of contact spring pieces protruding around a resilient plate. The movable contact spring piece is integrally mounted on the lower surface of the slider body while the center point of the slider body is aligned with the center point of the movable contact spring piece; and a sliding bridge is formed from two lower bridges and two upper bridges, integrally built in a #-like, square, or rectangular shape. Whereby the two lower bridges being rectangular strips arranged in parallel which are slidably fixed along the two parallel guide grooves in the base, where the two upper bridges are rectangular strips arranged in parallel which are also slidably fixed along the two parallel guide grooves in the slider.

The two parallel, lower bridges of the sliding bridge are fitted in the two parallel guide grooves on the surface of said base. The two parallel upper bridges of the sliding bridge are fitted in the two parallel guide grooves in the lower surface of the slider. The sliding bridge is inserted between the surface of the base and the lower surface of the slider. The slider confronts the base so as to be free to slid in a desired direction. A resilient return means is arranged around the slider and a resilient force maintains alignment between the center point of the base and the center point of the slider. Each of the stationary contacts of the base and each of the contacts of the movable contact spring piece of the slider, are placed so as to confront each other.

When the slider moves a set distance in a desired direction from the center point and returns toward the center point by means of the resilient return member, a movable contact of the movable contact spring piece is connected or disconnected to/from a desired stationary contact. This movement provides a switching function, mode switching function, and other electrical function, whereby one or more movable contacts are connected or disconnected to/from one or more of the stationary contacts.

According to another aspect of the present invention, the slide switch comprises; a base, including a plurality of patterned spaces of arbitrary shape in which stationary contacts are formed on an assumed circular path around a center point on a surface of the base. Whereby at least one stationary contact of a arbitrary patterned circuit is exposed and formed on each of the patterned spaces. A terminal for the at least one stationary contact protrudes from the base is provided. Two guide grooves of a set length are formed in parallel on the surface and formed in the X or Y axis direction to be symmetrical about the center point. The base includes resilient return means arranged around an assumed position of the slider on the surface and at regular intervals. The slider further comprises an opening, where a push button/operation knob is installed in the middle portion of the upper surface of the slider body in a circular, polygonal, or square plate. Said push button/operation knob is inserted into the opening such that the upper portion of said knob protrudes upward and moves vertically and freely. Fan-like raised portions are formed at positions symmetrical about the center point of the lower surface of the slider body. Two guide grooves of a set length are formed respectively on the raised portions, in parallel to the Y or X axis direction and symmetric about the center point. The slider includes a movable contact spring piece, with a plurality of contact spring pieces protruding around the center hole of the resilient plate. Said movable contact spring piece is integrally mounted to a lower portion on the lower surface of the slider body, while the center point of the slider body is aligned with the center point of the movable contact spring piece. The resilient return plate is suspended below the lower surface of the push button/operation knob, such that when the push button/operation knob is pushed down, a resilient force causes the push button/operation knob to return to its original position. A sliding bridge formed of two lower bridges and two upper bridges, is integrally built in a #-like, square, or rectangular shape. Whereby the two lower bridges, being rectangular strips arranged in parallel and slidably fixed along the two parallel guide grooves in said base. The two upper bridges being rectangular strips arranged in parallel and slidably fitted along two parallel guide grooves in the slider.

The two parallel lower bridges of the sliding bridge are fitted in said two parallel guide grooves in the surface of the base. The two parallel upper bridges of the sliding bridge are fitted in the two parallel guide grooves in the lower surface of the slider. The sliding bridge is inserted between the surface of the base and the lower surface of the slider. The slider confronts the base so as to be freely slid in a desired direction. The resilient return means is in contact with, and arranged around the slider at regular intervals, whereby a resilient force maintains alignment between the center point of the base and the center point of the slider. A movable contact spring disk is inserted between a stationary contact at the center of the base and the center of the lower surface of the push button/operation knob mounted on the slider. Each of the stationary contacts of the base and each of the movable contacts, of the movable contact spring piece of the slider are placed so as to confront each other.

When the slider moves a set distance in a desired direction from the center point and returns toward the center point by means of the resilient return member, a movable contact of the movable contact spring piece is connected or disconnected to/from a desired stationary contact. Alternatively, when the push button/operation knob is pushed down and the resilient plate is restored, the movable contact spring disk is disconnected from a stationary contact at the center of said base. This movement provides a switching function, mode switching function, or other electrical function where one or more movable contacts are connected or disconnected to/from one or more stationary contacts. According to another aspect of the present invention, the slide mechanism comprises; a base having a surface in which two guide grooves of a set length are formed in parallel in the X- or Y-axis direction; a slider on which two grooves of a set length are formed in parallel in the Y- or X axis direction on the lower surface of a strip, in a circular or arbitrary shape; and a sliding bridge formed of two lower bridges and two upper bridges, integrally built in a #-like, square, or rectangular shape. Whereby, the two lower bridges are rectangular strips arranged in parallel and are slidably fixed along the two parallel guide grooves in the base. Said two upper bridges are rectangular strips arranged in parallel which are slidably fixed along the two parallel guide grooves in the slider. The two parallel lower bridges of the sliding bridge are fitted in the two parallel guide grooves, in the surface of the base. The two parallel upper bridges of the sliding bridge are fitted in the two parallel guide grooves, in the lower surface of the slider. With the sliding bridge inserted between the surface of the base and the lower surface of the slider, the slider is provided to the base to slide in a desired direction.

BRIEF DESCRIPTION OF THE DRAWINGS

The invention may be carried into practice in various ways and some embodiments will now be described by way of example with reference to the accompanying drawings, in which.

DETAILED DESCRIPTION OF THE PREFERRED EMBODIMENTS

A slide switch according to an embodiment of the present invention will be described below by referring to FIGS. 1 to 10.

Slide Switch S1

Figure 5:
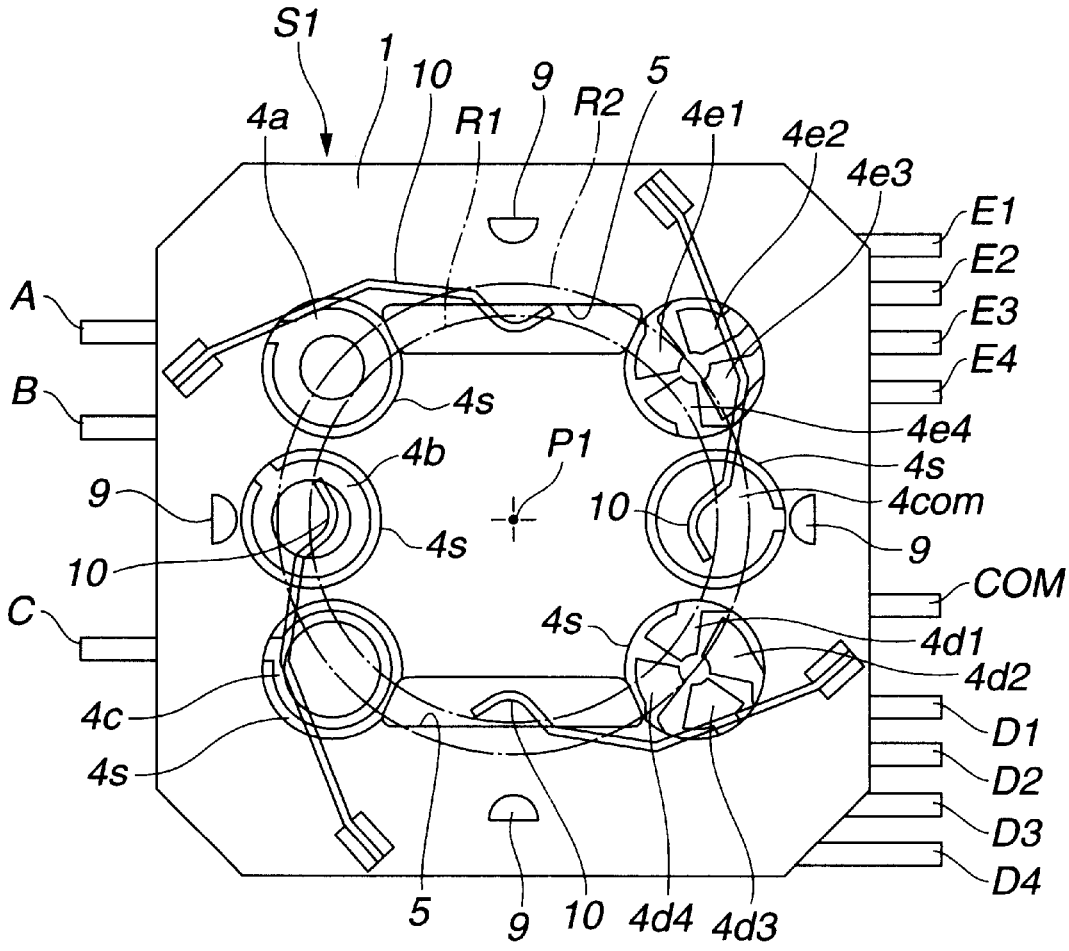
FIG. 5 is a front view illustrating a base.
Figure 6:
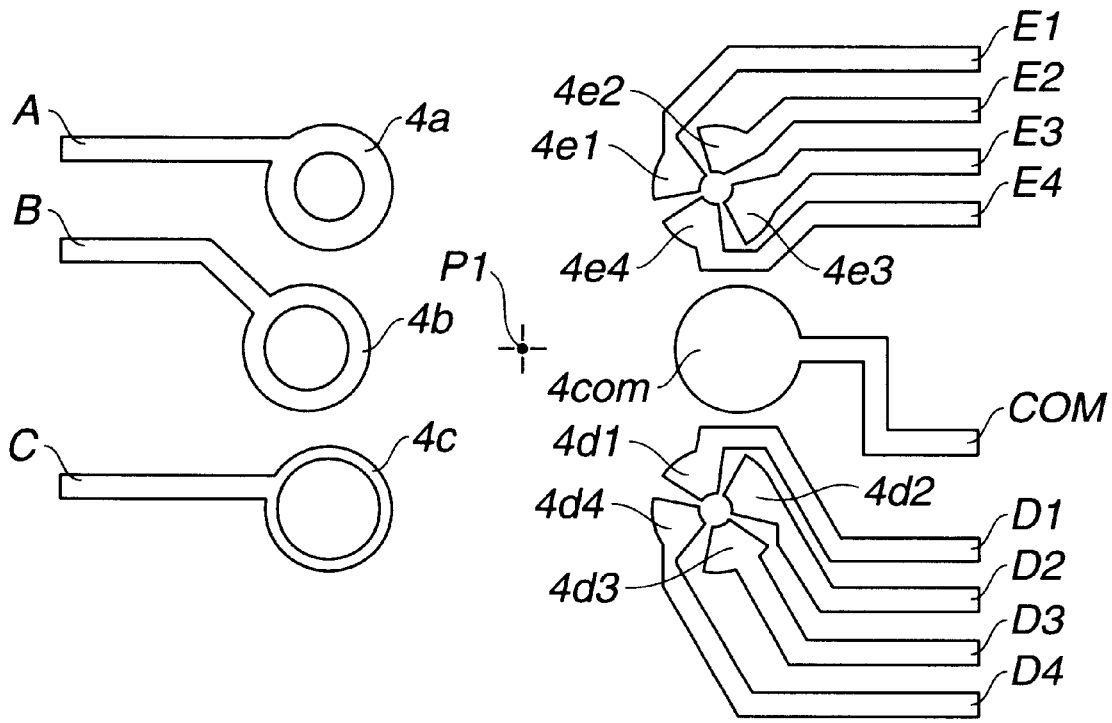
FIG. 6 is a view illustrating a pattern of stationary contacts on the base.

Referring to FIGS. 5 and 6, a base 1 has a series of spaces 4*s* for stationary contacts 4 in a pattern on its surface. These patterned spaces 4*s* are set on a notional circular path R1 and R2, each having a set radius with respect to the center point P1 on the surface of the base 1. Each pattern space 4*s* has an arbitrary shape such as circular, oval, semicircular, quarter circular, arc-shaped (angled at a given degree), rectangular, or polygonal. In each pattern space 4*s*, the stationary contact 4 (4*com*) of a circular pattern circuit, a ring pattern circuit (4*a*, 4*b*, 4*c*), or a quarter circular pattern circuit (4*d*1 to 4*d*4, 4*e*1 to 4*e*4) is exposed. Terminals COM, A, B, C, D1 to D4, E1 to E4 extend out from the base 1. Two guide grooves 5, 5 of a set length are formed in parallel on the surface of the base 1 in the X axis direction and are symmetrical about the center point P1. Resilient return members 10 such as springs are disposed on the surface and arranged around the assumed set positions of the slider 2, at regular intervals. Stops 9 are arranged around the assumed path of the slider 2.

Figure 7:
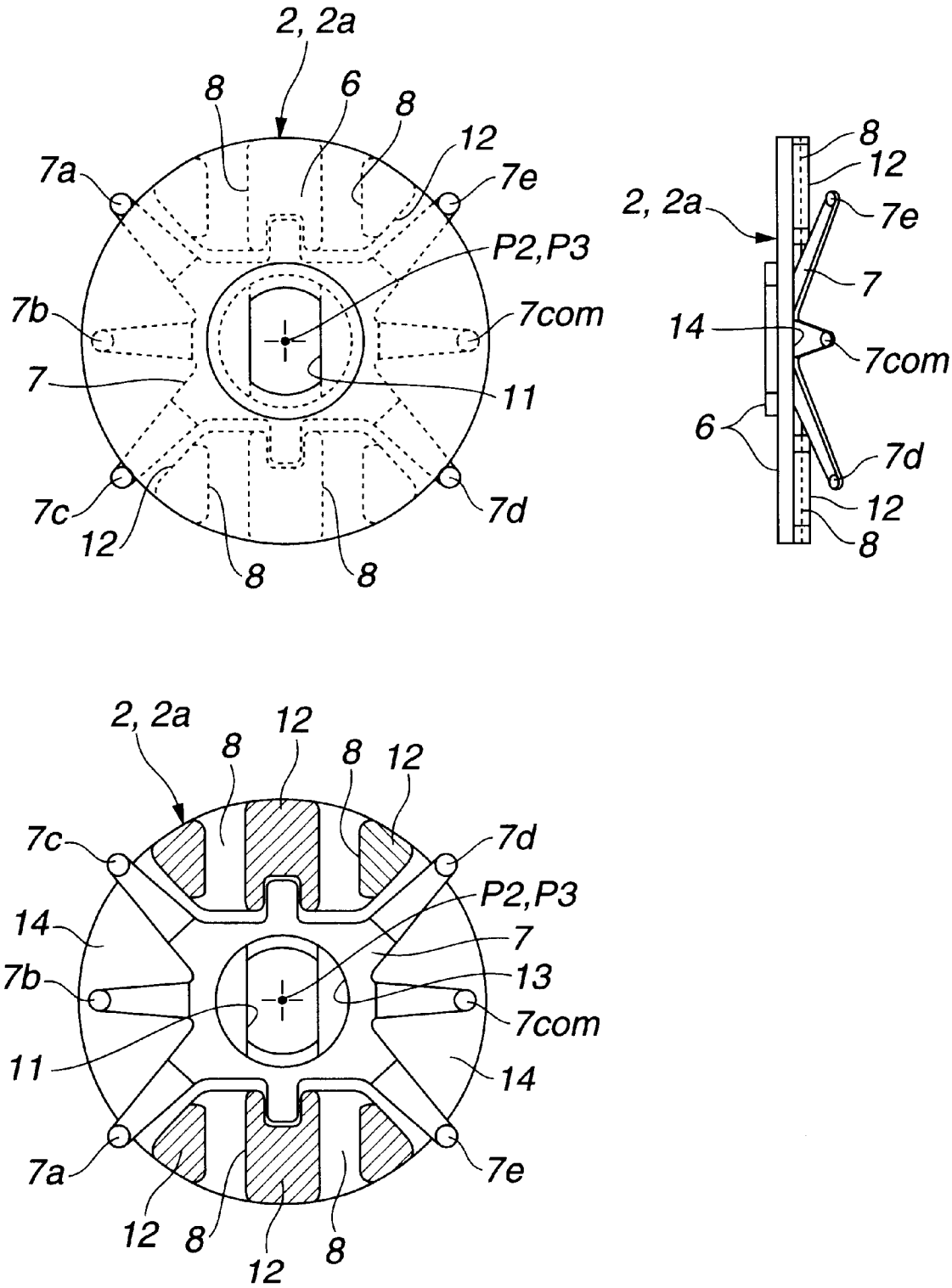
FIG. 7 illustrates the front, back, and right side surfaces of the slider.
Figure 8:
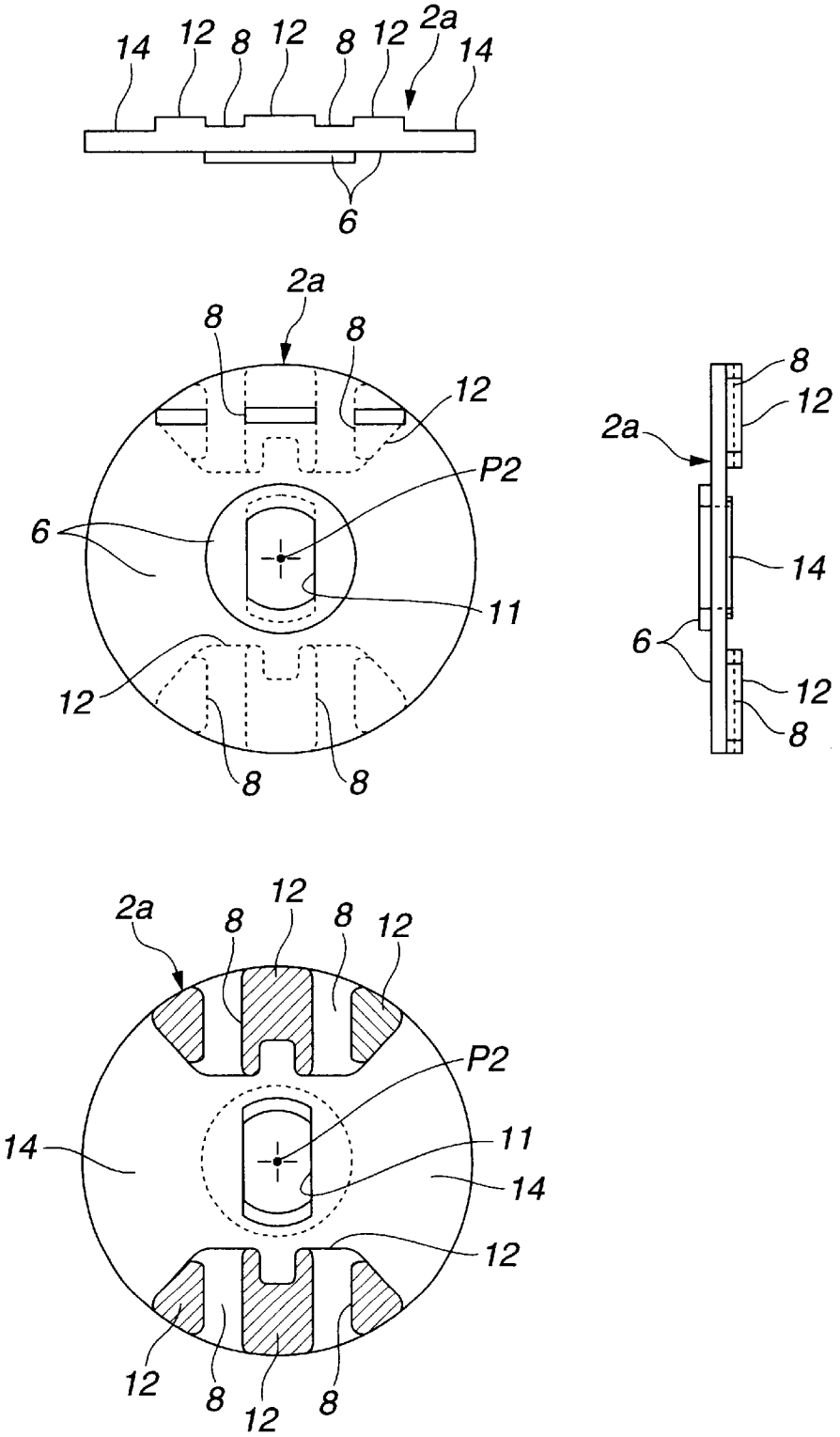
FIG. 8 illustrates the front side, plan surface, back surface, and right side surface of the main body of the slider.
Figure 9:
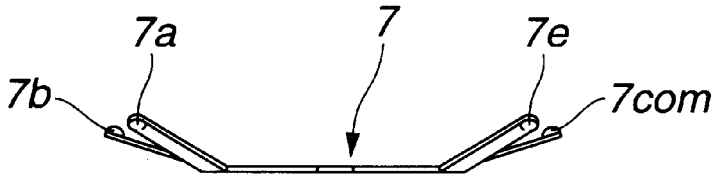
FIG. 9 illustrates the front, plan, and right side surfaces of a movable contact spring piece.
Figure 9:
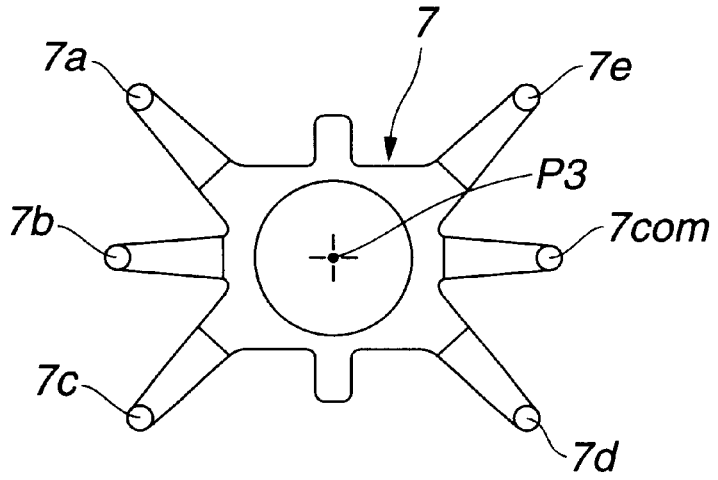
Figure 9:
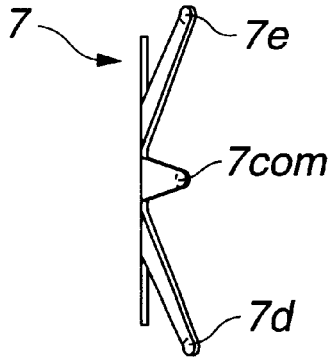

Referring to FIGS. 7 and 8, the slider has an operable portion 6 being the upper surface of the slider body 2*a*, and a fan-like raised portion 12, 12, which is vertically symmetrical to the center hole 11, in the lower surface. The slider body 2*a* is a circular, polygonal or square plate. Two guide grooves 8, 8 of a set length are formed in parallel in the Y-axis direction and are symmetrical about the center point P2. Referring to FIG. 9, the movable contact spring piece 7, has contact spring pieces protruding from the center hole 13 of the resilient plate. The ends of the contact spring pieces are movable contacts 7*com*, 7*a*, 7*b*, 7*c*, 7*d*, and 7*e*. The movable contact spring piece 7 is integrally attached to the lower portion 14 of the slider body 2*a*, while the center point P2 of the center hole 11 is aligned with the center point P3 of the center hole 13.

Figure 10:
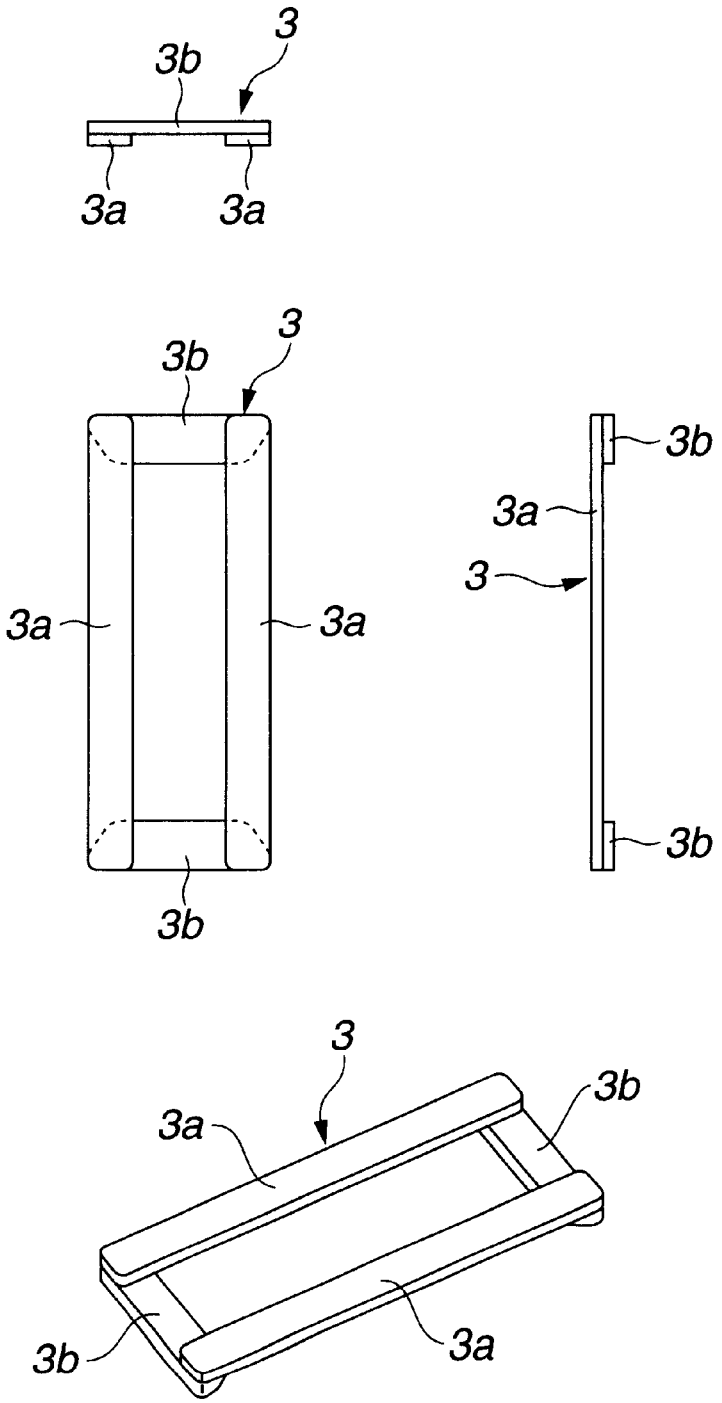
FIG. 10 illustrates the front, plan, and right side surfaces, together with an oblique view of a sliding frame.
Figure 11:
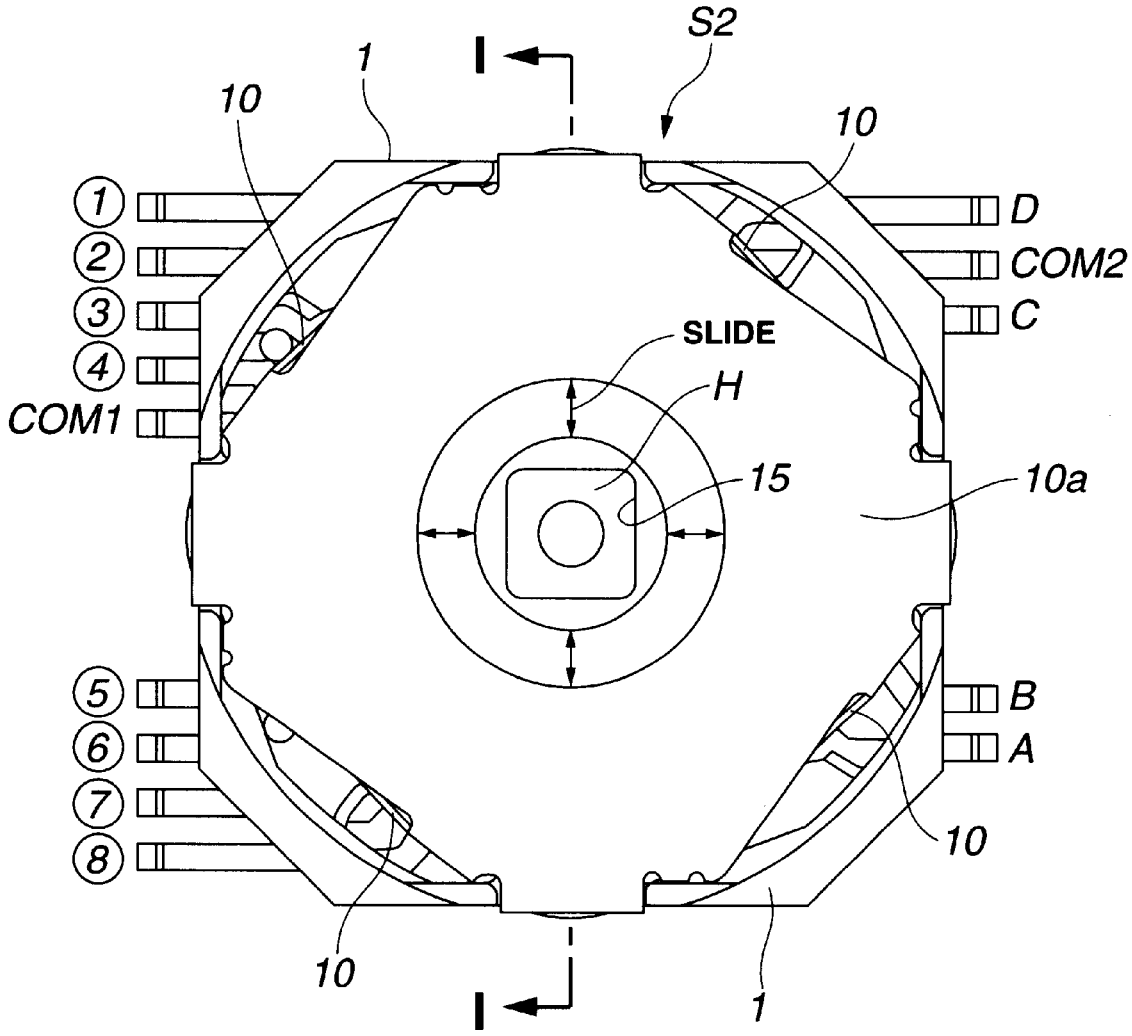
FIG. 11 is a front view of a slide switch S2 according to an embodiment of the present invention.

Referring to FIG. 10, the sliding bridge 3 is a rectangular frame formed of two lower bridges 3*b*, 3*b* being rectangular strips arranged in parallel and two upper bridges 3*a*, 3*a* being rectangular strips arranged in parallel. The two lower bridges 3*b*, 3*b* slide freely along the guide grooves 5, 5 formed in parallel in the base 1. The two upper bridges 3*a*, 3*a* slide freely along the guide grooves 8, 8 formed in parallel on the slider.

The two lower bridges 3*b*, 3*b* are fitted to the two guide grooves 5, 5 respectively, in the surface of the base. The upper bridges 3*a*, 3*a* are fitted to the two guide grooves 8, 8 respectively, in the under surface of the slider 2. The sliding bridge 3 is inserted between the surface of the base 1 and the lower surface of the slider 2. The slider 2 confronts the base 1 so as to slide freely in a desired direction.

Figure 1:
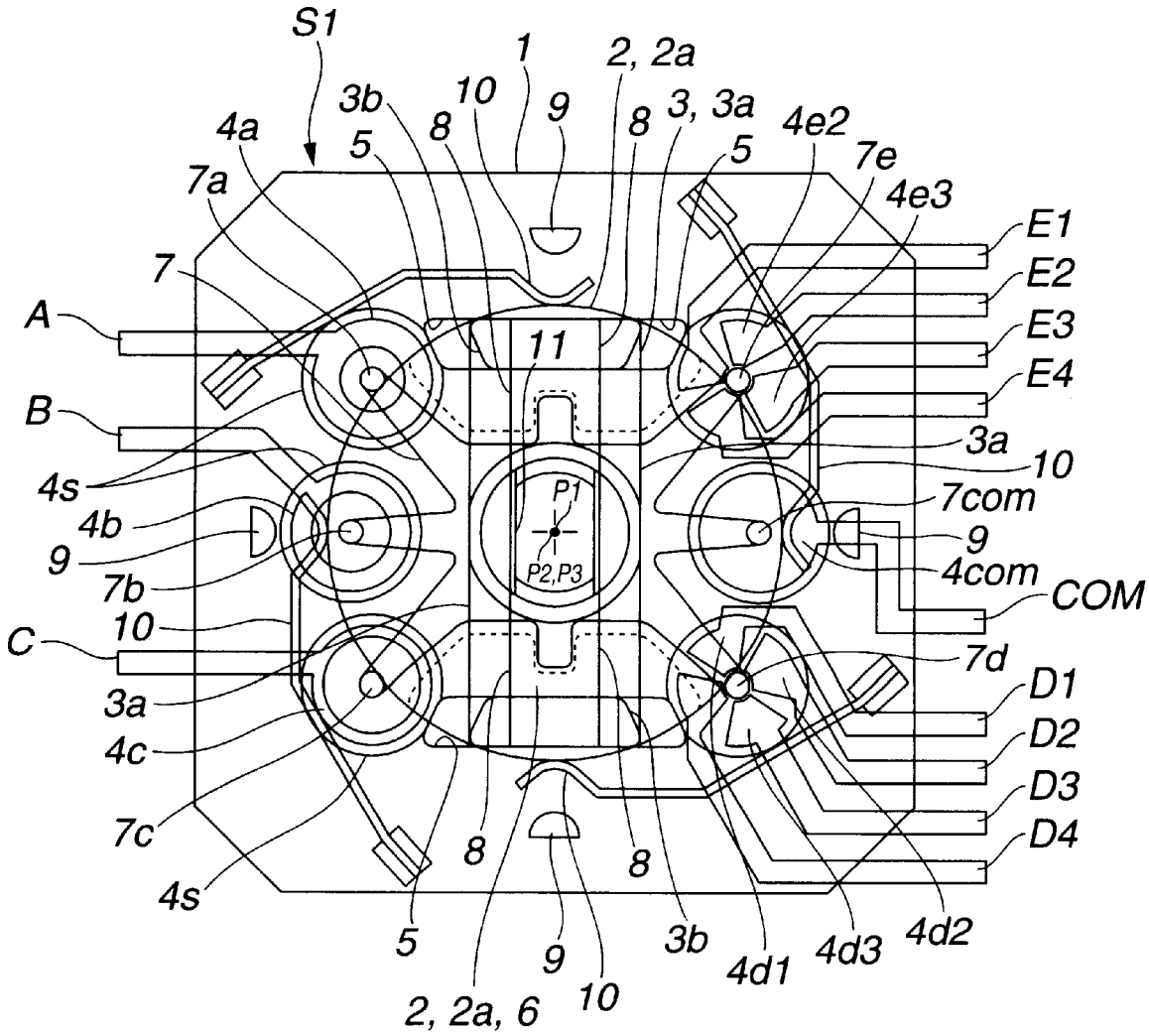
FIG. 1 is a front see-through view schematically illustrating the structure of a slide switch S1 according to an embodiment of the present invention.

The resilient return members 10 are disposed at regular intervals and are in contact with the peripheral areas of the slider 2. The resilient force of the resilient return member 10 aligns the center point P1 of the base 1 with the center point P2 of the slider 2. As shown in FIG. 1, the stationary contacts 4*com*, 4*a*, 4*b*, 4*c*, 4*d*, 4*d* 1 to 4*d* 4, 4*e*1 to 4*e*4 of the base 1 are disposed in opposition to the movable contacts 7*com*, 7*a*, 7*b*, 7*c*, 7*d*, and 7*e* of the movable contact spring piece 7.

Referring to FIGS. 1 to 4, when the slider 2 moves a set distance in a desired direction from the center point P1, for example, to a position where it rests against the stop 9, or is returned toward the center point P1 by the resilient return member 10, the movable contact (7*com*, 7*a*, 7*b*, 7*c*, 7*d*, 7*e*) of the movable contact spring piece 7 is connected or disconnected to/from the desired stationary contact (4*com*, 4*a*, 4*b*, 4*c*, 4*d*1 to 4*d*4, 4*e*1 to 4*e*4). Thus, the slide switch S1 can implement a desired switching function, a mode switching function, or an electrical function where one or more movable contacts and one or more stationary contacts are connected or disconnected.

The resilient return member 10 is means of restoring the slider 2 from a selected position toward the center point P1. For example, the resilient return member 10 may be a leaf spring, a coil spring, a conical spring, or a natural or synthetic rubber member.

The slider body 2*a* has an arbitrary shape including a circle, polygon or square. The movable contact spring piece 7 to be mounted on the slider body has a plurality of contact spring pieces protruding radially from a resilient plate, at equal or unequal angles. The contact spring pieces have the ends on which movable contacts 7*a* are formed. The resilient plate has an arbitrary shape including a circle, polygon or square. The movable contacts 7*a* are disposed in opposition to the stationary contacts 4*a* of the base.

In the sliding bridge 3, the two lower bridges are fitted to the two guide grooves formed in the surface of the base. The two upper bridges are fitted to the two guide grooves formed in the lower surface of the slider. With the sliding bridge inserted between the base surface and the lower surface of the slider, the slider slides over the base, along the guide grooves formed in the Y- or X-axis direction of the slider, along the guide grooves formed in the X- or Y-axis direction of the base and in the composite direction of them. Thus, the slider is free to move in a desired direction, for example, vertically, horizontally, or in oblique directions. The slider cannot, however be rotated.

Slide Switch S2

The slide switch S2 according to another embodiment of the present invention will be explained by referring to FIGS. 11 to 35.

Figure 17:
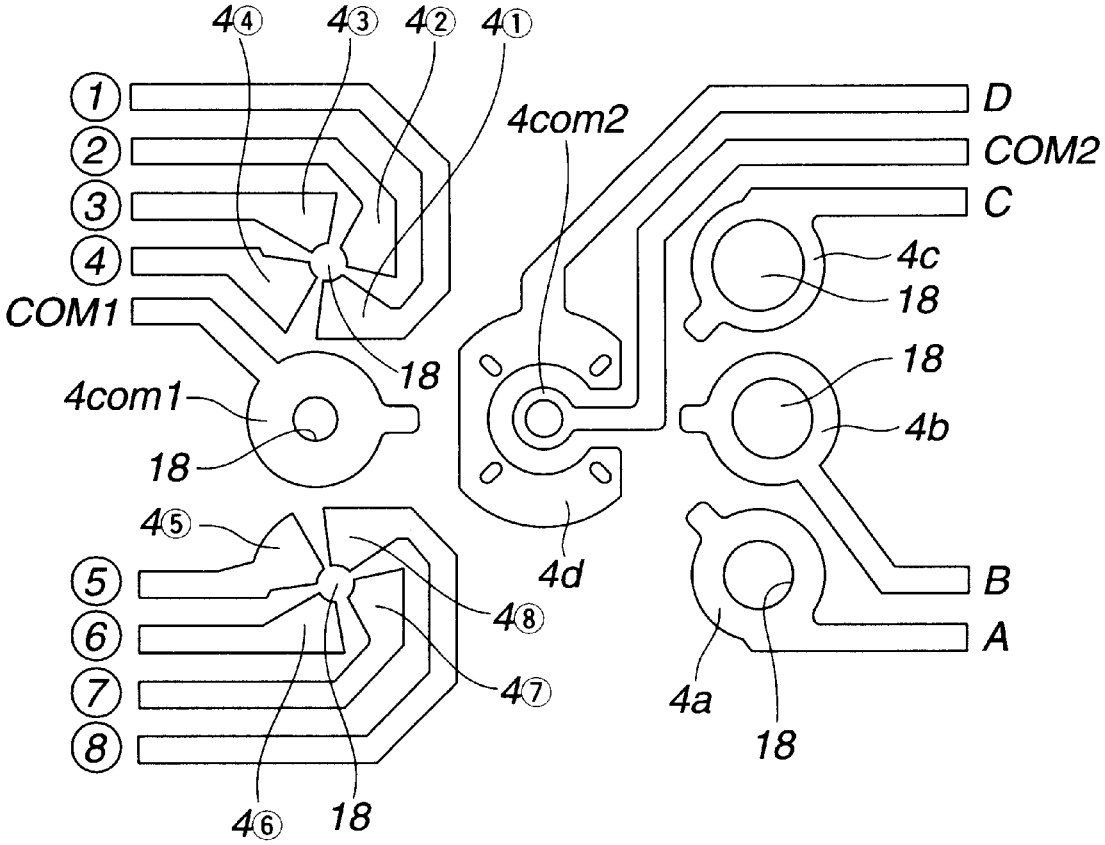
FIG. 17 is a diagram illustrating a pattern of stationary contacts of the base.
Figure 18:
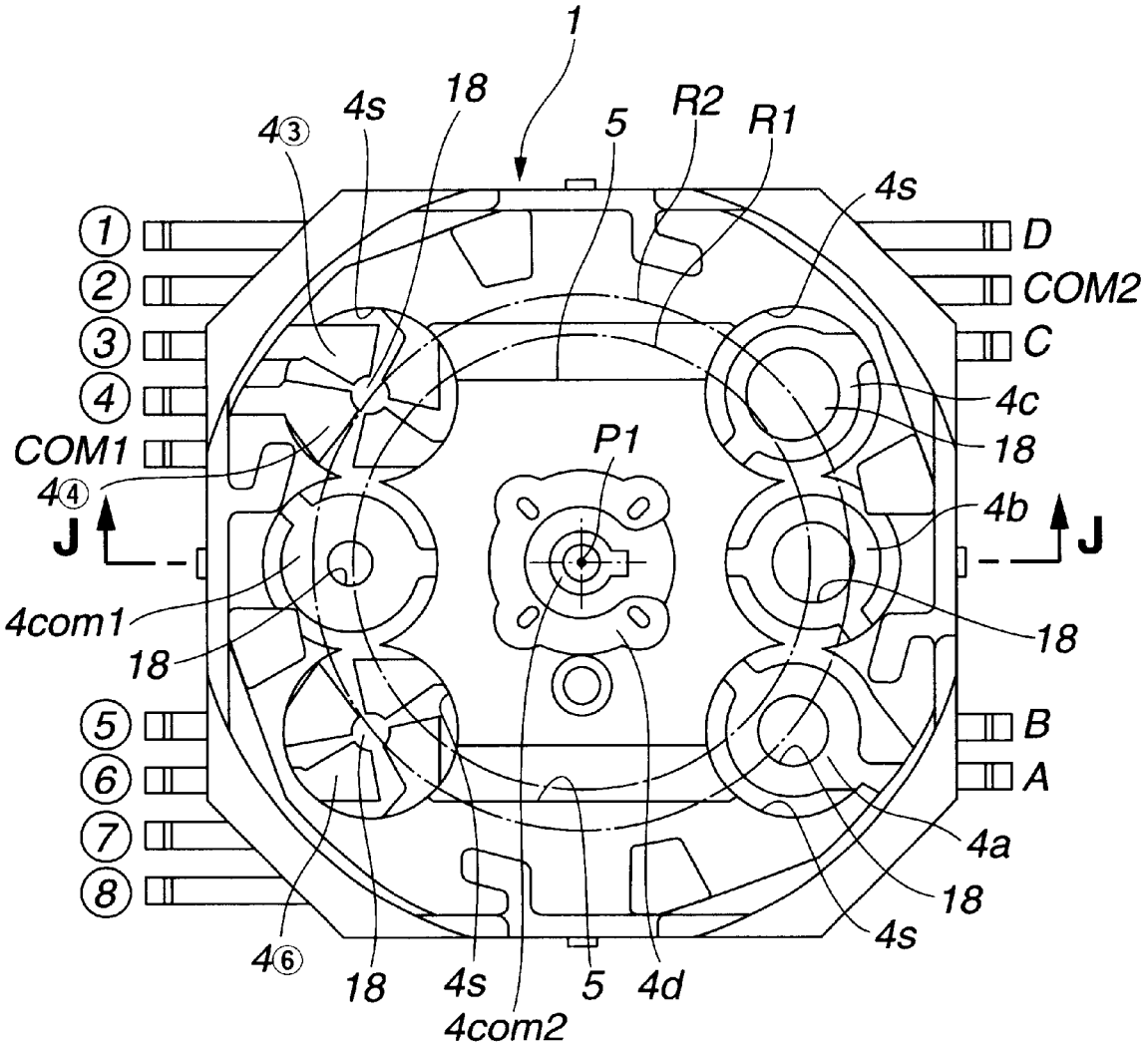
FIG. 18 is a front view of the base.
Figure 19:
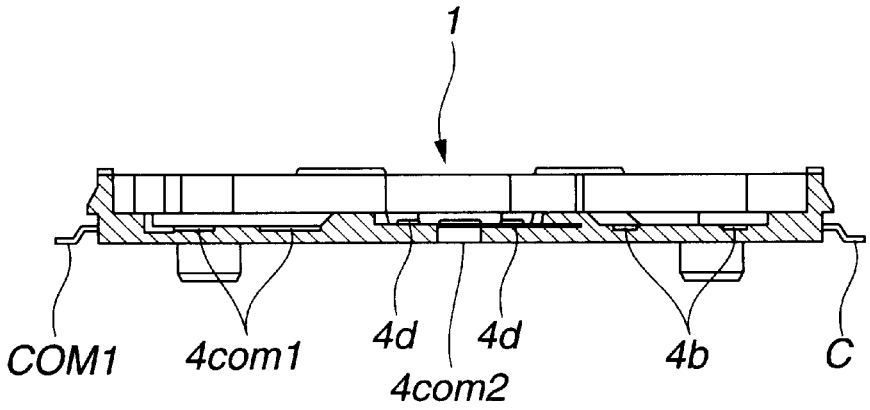
FIG. 19 is a cross-sectional view illustrating the base taken in the direction of the arrows along the line J—J of FIG. 18.
Figure 20:
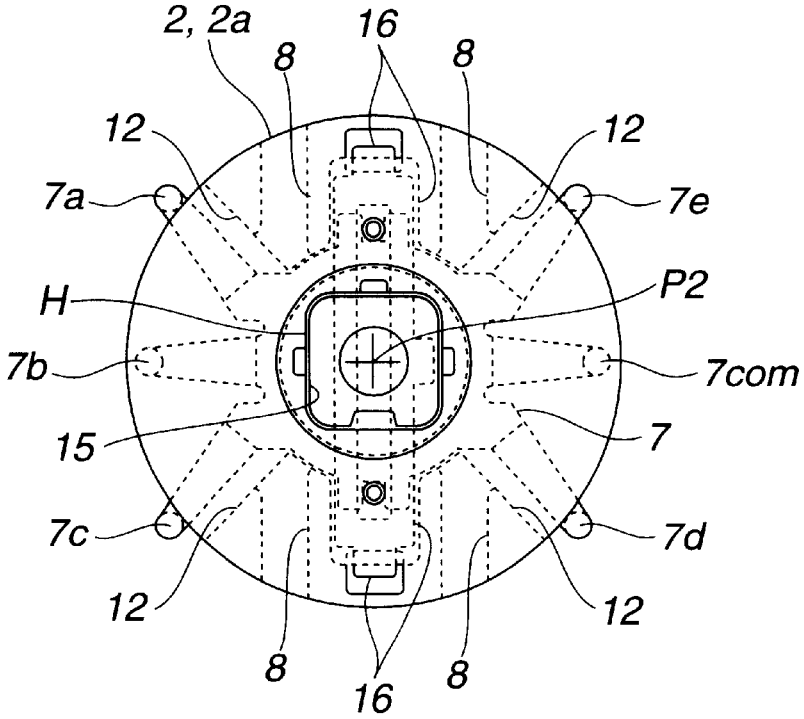
FIG. 20 is a front view illustrating a slider.
Figure 21:
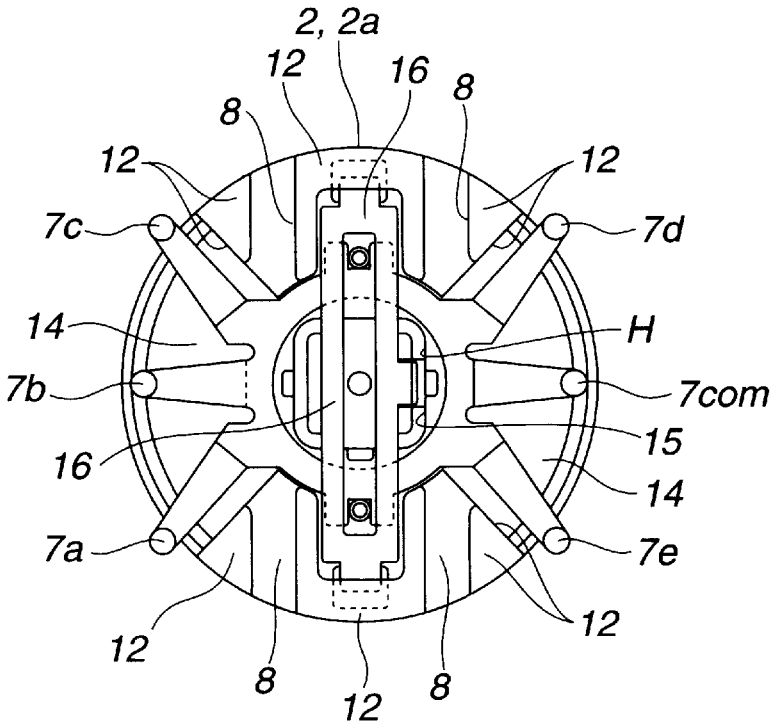
FIG. 21 is a back view illustrating the slider.
Figure 22:
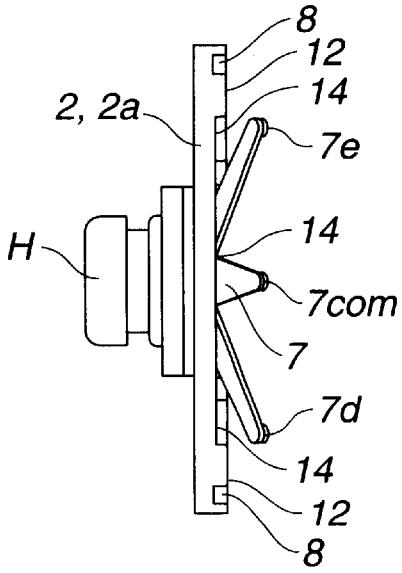
FIG. 22 is a view illustrating the right side of the slider.
Figure 23:
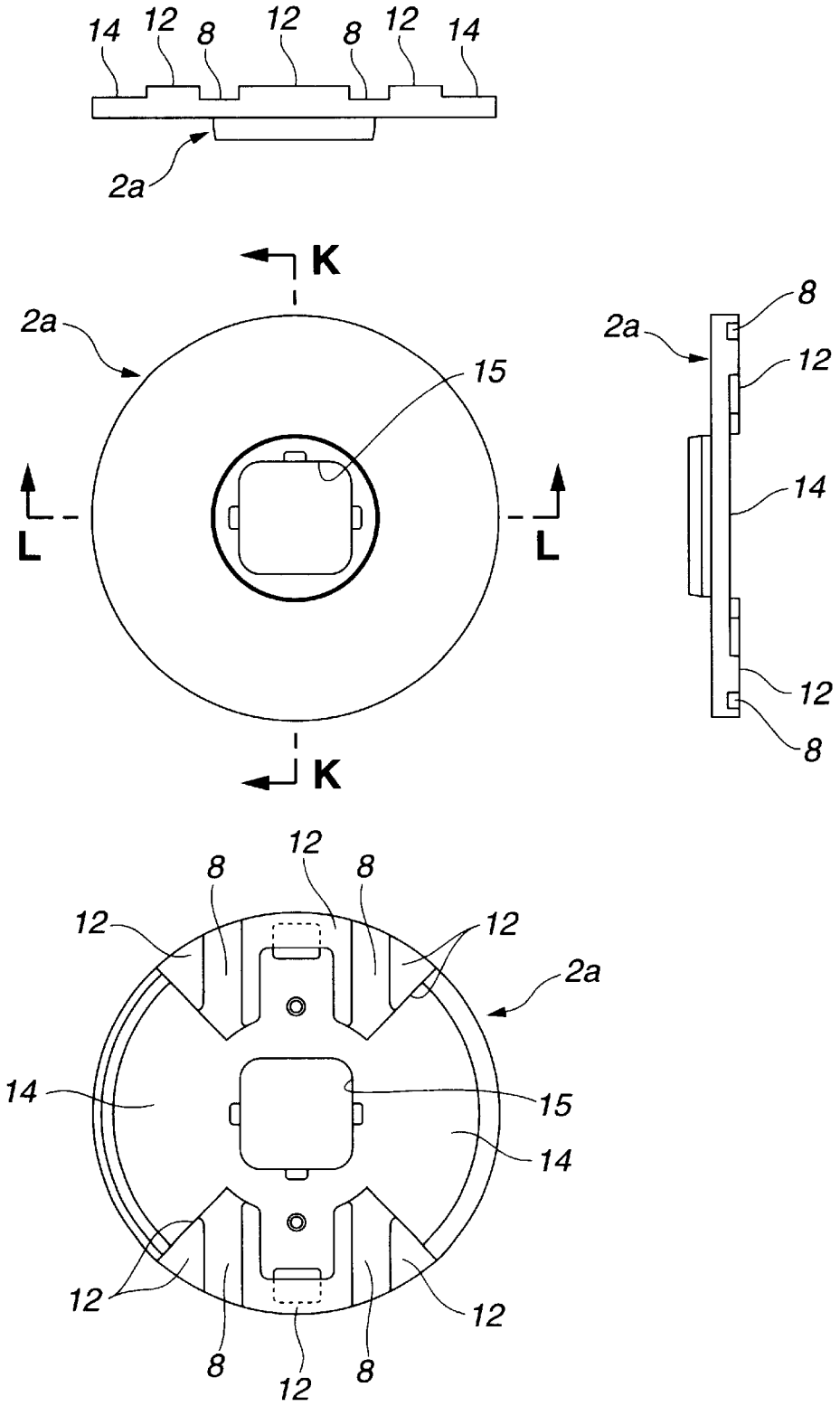
FIG. 23 illustrates the front, back, plan, and the right side surfaces of the slider body.
Figure 24:
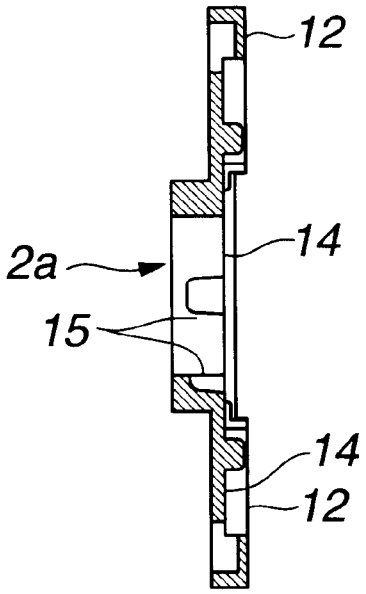
FIG. 24 is a cross-sectional view illustrating the slider taken in the direction of the arrows along the line K—K of FIG. 23.
Figure 25:
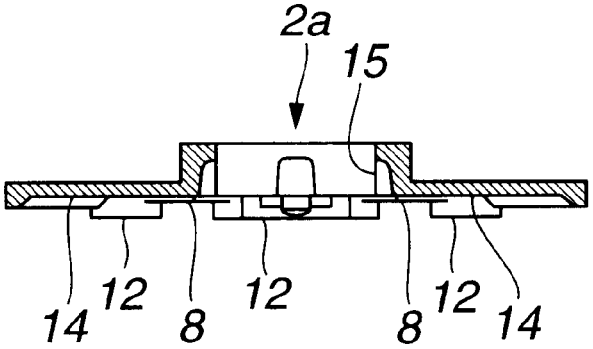
FIG. 25 is a cross-sectional view illustrating the slider taken in the direction of the arrows along the line L—L of FIG. 23.

Referring to FIGS. 17 and 19, a base 1 has a plurality of patterned spaces 4*s* for stationary contacts 4 on the surface thereof. These pattern spaces 4*s* are set on a notional circular path R1 and R2, each having a set radius with respect to the center point P1 on the surface of the base 1. Each patterned space 4*s* has an arbitrary shape including circular, oval, semi-circular, quarter circular, arc-shaped (angled at a given degree), rectangular, or polygonal. In each patterned space 4*s*, stationary contacts 4 (4*com*1, 4①, 4②, 4③, 4④, 4⑤, 4⑥, 4⑦, 4⑧, 4*com*2, a, b, c, d) are formed of at least one of said arbitrary shapes. Terminals COM1, ①, ②, ③, ④, ⑤, ⑥, ⑦, ⑧, COM2, A, B, C, D extend out from the base 1. Two guide grooves 5, 5 of a set length are formed in parallel on the surface of the base 1 in the X- or Y-axis direction and are symmetrical about the center point P1.

Figure 30:
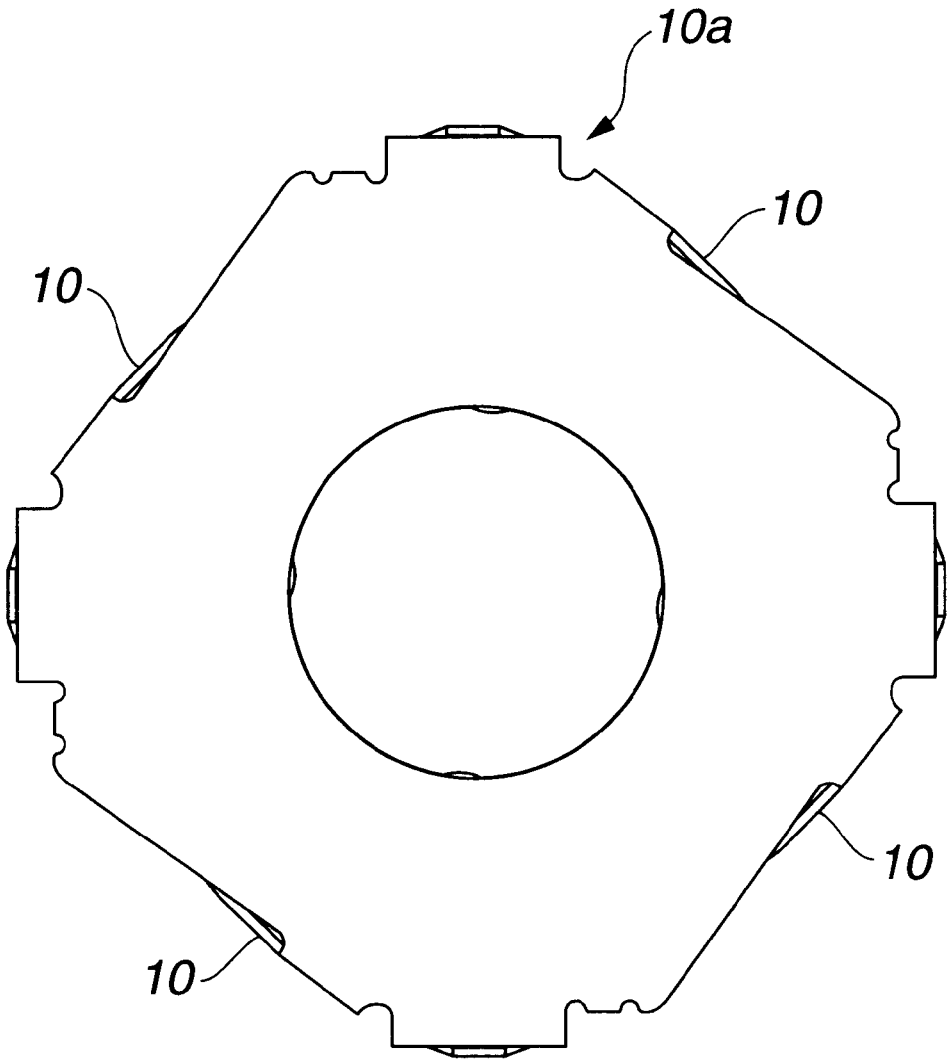
FIG. 30 is a front view illustrating a metal cover plate/return spring (resilient return member)
Figure 31:
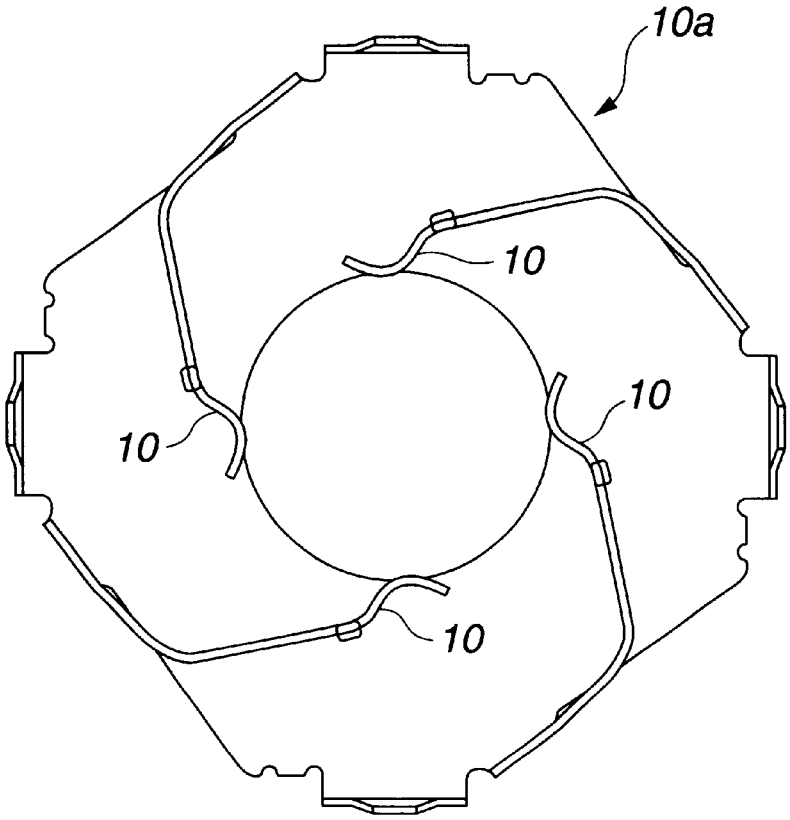
FIG. 31 is a back view illustrating a metal cover plate/return spring (resilient return member)
Figure 32:
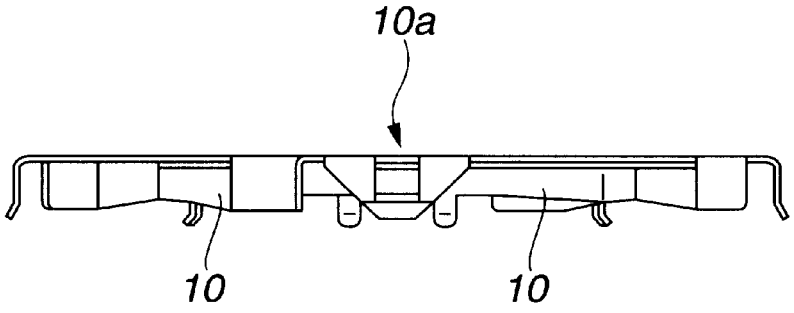
FIG. 32 is a base view illustrating a metal cover plate/return spring (resilient return member)

Resilient return members 10 such as springs are disposed on the surface and arranged at regular intervals around the notional set positions on the slider 2. For example, as shown in FIGS. 30 to 32, a metal cover plate/return spring 10*a*, being a square metal cover plate of which the four sides are folded down, is used as the resilient return member 10.

Figure 26:
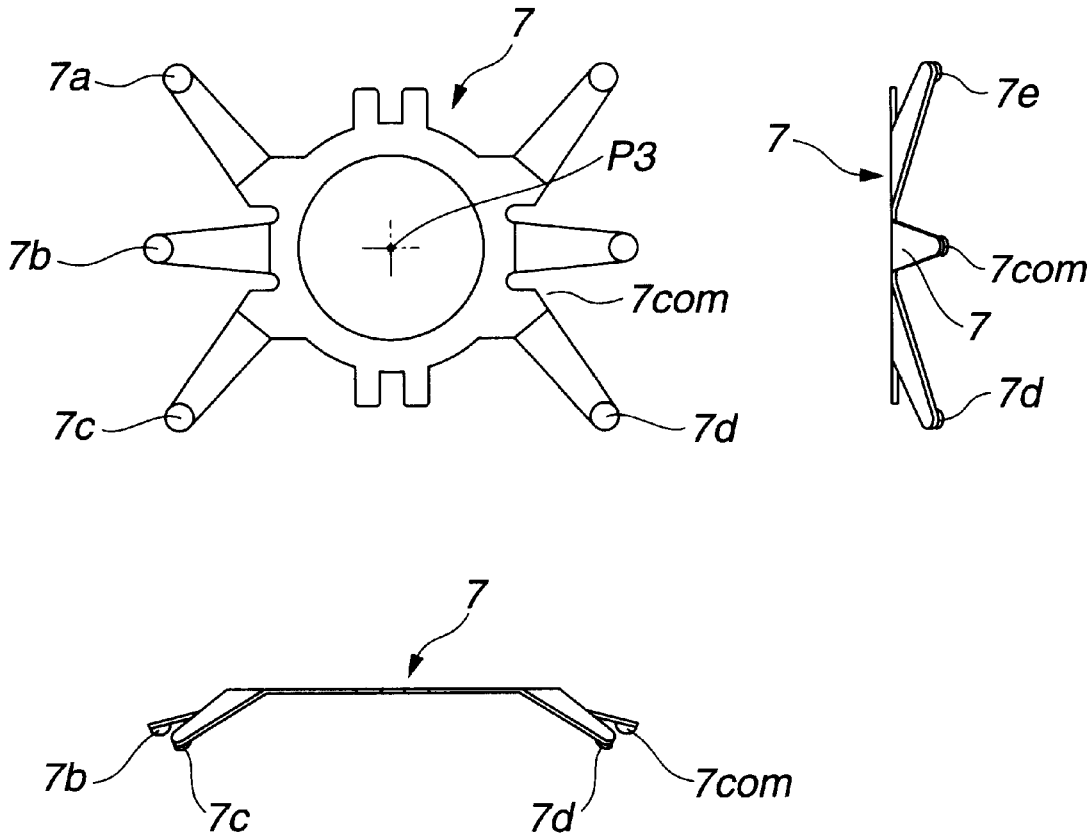
FIG. 26 illustrates the front, base and right side surfaces of a variable contact spring piece.
Figure 27:
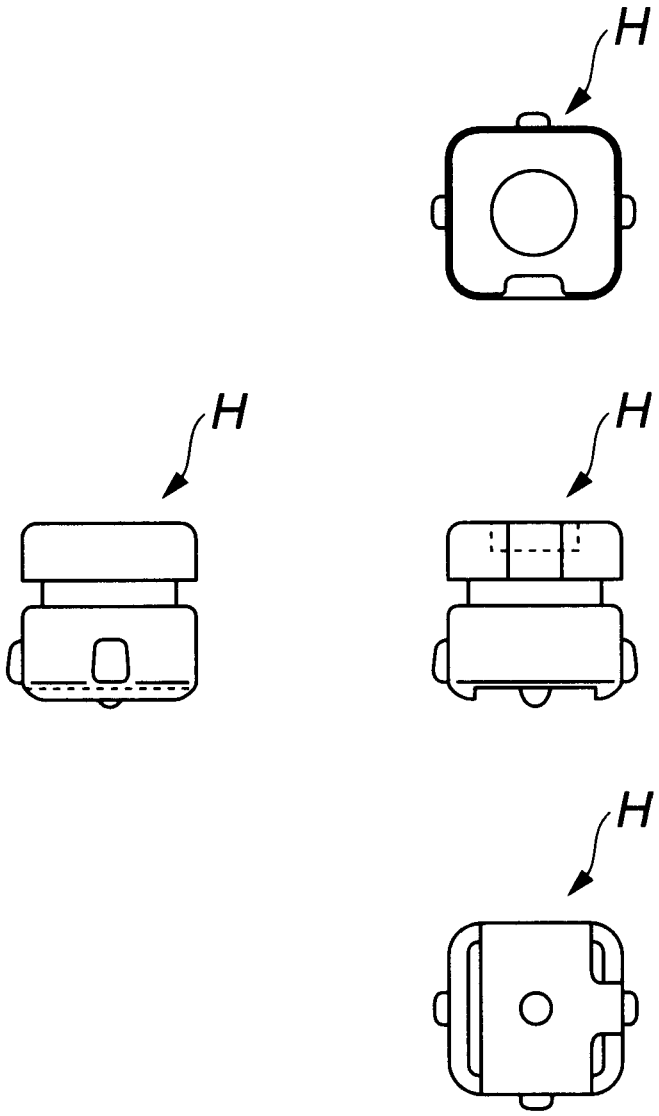
FIG. 27 illustrates the front, plan, base and left side surfaces of the push button/operation knob.
Figure 28:
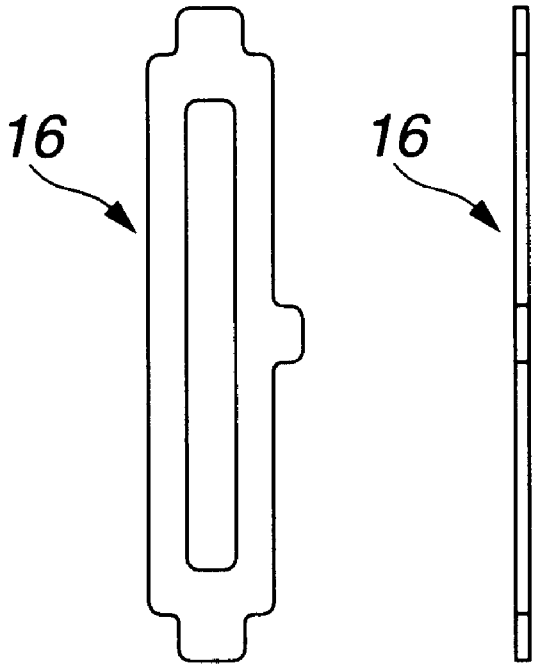
FIG. 28 illustrates the front surface and right side surface of a return resilient plate.

In the slider 2 (FIGS. 20 and 22), a hole for the push button/operation knob H is formed in the center of the upper surface of the slider body 2*a* (FIGS. 23 to 25) being a circular, polygonal or square plate. The push button/operation knob H is inserted into the hole 15 and the upper portion thereof protrudes upward by a set length so as to move freely in a vertically direction. Raised fan-like portions 12, 12 are formed to be vertically symmetrical about the center point P2 of the lower surface of the slider body 2*a*. Two guide grooves 8, 8, of a set length, are formed in parallel and in the Y-axis direction, whereby the raised portions 12, 12 are symmetrical about the center point P2. Referring to FIG. 26, the movable contact spring piece 7 has a plurality of contact spring pieces extending out from the center hole 13 of the resilient plate. The ends of the contact spring pieces 7 are movable contacts 7*com*, 7*a*, 7*b*, 7*c*, 7*d*, and 7*e*. The movable contact spring piece 7 is integrally attached to the lower portion 14 of the slider body 2*a* while the center point P1 of the movable contact spring piece 7 is aligned with the center point P2 of the slider body 2*a*. The return resilient plate 16 (FIG. 28) is suspended over the lower surface of the push button/operation knob H. Referring to FIGS. 20 to 28, the resilient force restores the push button/operation knob H its original position.

Figure 29:
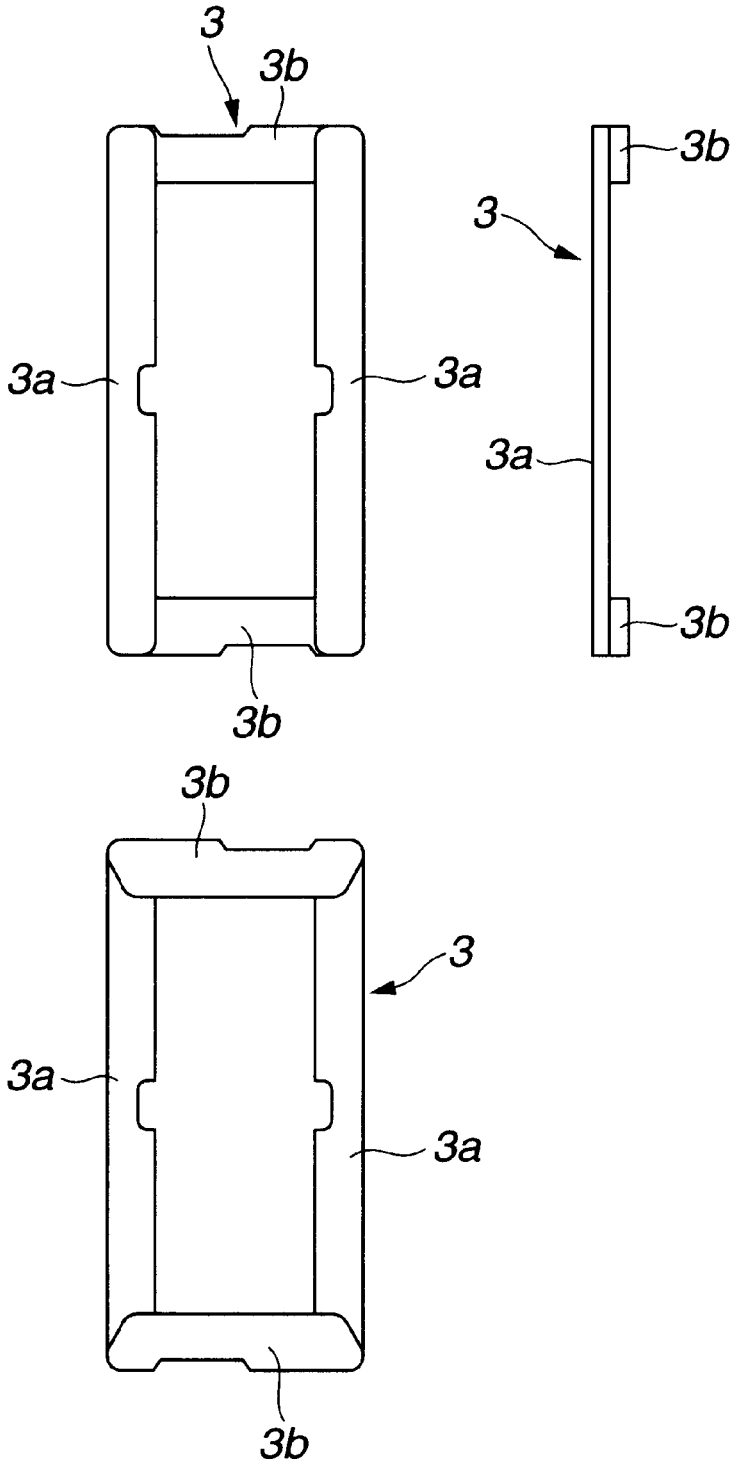
FIG. 29 illustrates the front, back and right side surfaces of a sliding bridge.

Referring to FIG. 29, the sliding bridge 3 is a rectangular frame formed of two lower bridges 3*b*, 3*b* being rectangular strips arranged in parallel, and two upper bridges 3*a*, 3*a* being rectangular strips arranged in parallel. The two lower bridges 3*b*, 3*b* slide freely along the guide grooves 5, 5 formed in parallel in the base 1. The two upper bridges 3*a*, 3*a* slide freely along the guide grooves 8, 8 formed in parallel in the slider.

The two lower bridges 3*b*, 3*b* are fitted to the two guide grooves 5, 5 respectively, in the surface of the base. The upper bridges 3*a*, 3*a* are fitted to the two guide grooves 8, 8 respectively, in the under surface of the slider 2. The sliding bridge 3 is inserted between the surface of the base 1 and the lower surface of the slider 2. The slider 2 confronts the base 1 so as to slide freely in a desired direction.

The resilient return members 10 such as the metal cover plate/return springs 10*a* are disposed at regular intervals and are in contact with the peripheral areas of the slider 2. The resilient force of the resilient return member 10 and aligns the center point P1 of the base 1 with the center point P2, of the slider 2.

In the slide switch S2, a movable contact spring disk 17 is inserted in opposition between the stationary contact 4*com*2, at the center of the base 1, and the center of the lower surface of the push button/operation knob H, mounted to the slider 2. The stationary contacts 4*com*1, 4*a* to 4*c*, 4① to 4⑧ of the base 1 are disposed in opposition to the movable contacts 7*com* and 7*a* to 7*e* of the movable contact spring piece 7, of the slider 2.

When the slider 2 moves a set distance in a desired direction from the center point P1, or is returned toward the center point P1 by the resilient return member 10, the movable contacts 7*com* and 7*a* to 7*e* of the movable contact spring piece 7 are connected or disconnected to/from the desired stationary contact 4*com*1, 4*a* to 4*d*1, 4① to 4⑧. Moreover, when the push button/operation knob H is pushed down and it returns to its original position by the return spring member 16, the movable contact spring disk 17 is connected or disconnected to/from the stationary contact 4*com*2 at the center of the base 1. Thus, the slide switch S2 can implement a desired switching function such as, a mode switching function, or an electrical function where one or more movable contacts and one or more stationary contacts are connected or disconnected.

In the slide switch S2, the slider body 2*a* of the slider 2 has an arbitrary shape including circular, polygonal or square. The movable contact spring piece 7 mounted on the slider body 2*a* and has a plurality of contact spring pieces protruding radially, at right and left angles from the center P3 of the resilient plate. These contact spring pieces have the ends on which movable contacts (e.g. 7*com*, 7*a* to 7*e*) are formed. The resilient plate has an arbitrary shape such as a circle, polygon, or square. The patterned circuits are partially exposed at the center points corresponding to the movable contacts (e.g. 7*com*, 7*a* to 7*e*) of the contact spring pieces, protruding at right and left angles, radially from the center P1 of the upper surface of the base 1. As shown in FIG. 17, each stationary contact 4 includes an OFF area in the center thereof and an ON area around the stationary contact 4. Each stationary contact 4 has an arbitrary shape such as a circle.

With the center P2 of the slider 2, the center P3 of the movable contact spring piece, and the center P1 of the base are 1 aligned together, the movable contacts (e.g. 7*com*, 7*a* to 7*e*) of the movable contact spring piece 7 are positioned respectively in the OFF areas 18, of the stationary contacts 4 (e.g. 4*com*1, 4*a* to 4*c*, 4① to 4⑧. When the slider 2 is slid horizontally a set distance, in a desired direction, the movable contacts (e.g. 7*com*1, 7*a* to 7*e*) are connected to one or more movable contacts (e.g. 4*com*1, 4*a* to 4*d*, 4① to 4⑧. Thus, the output patterns (the switching functions) corresponding to at least the product of the number of movable contacts (FIG. 6)×the number of stationary contacts (FIG. 12) are formed. This product depends on the shape and area of a stationary contact.

Figure 12:
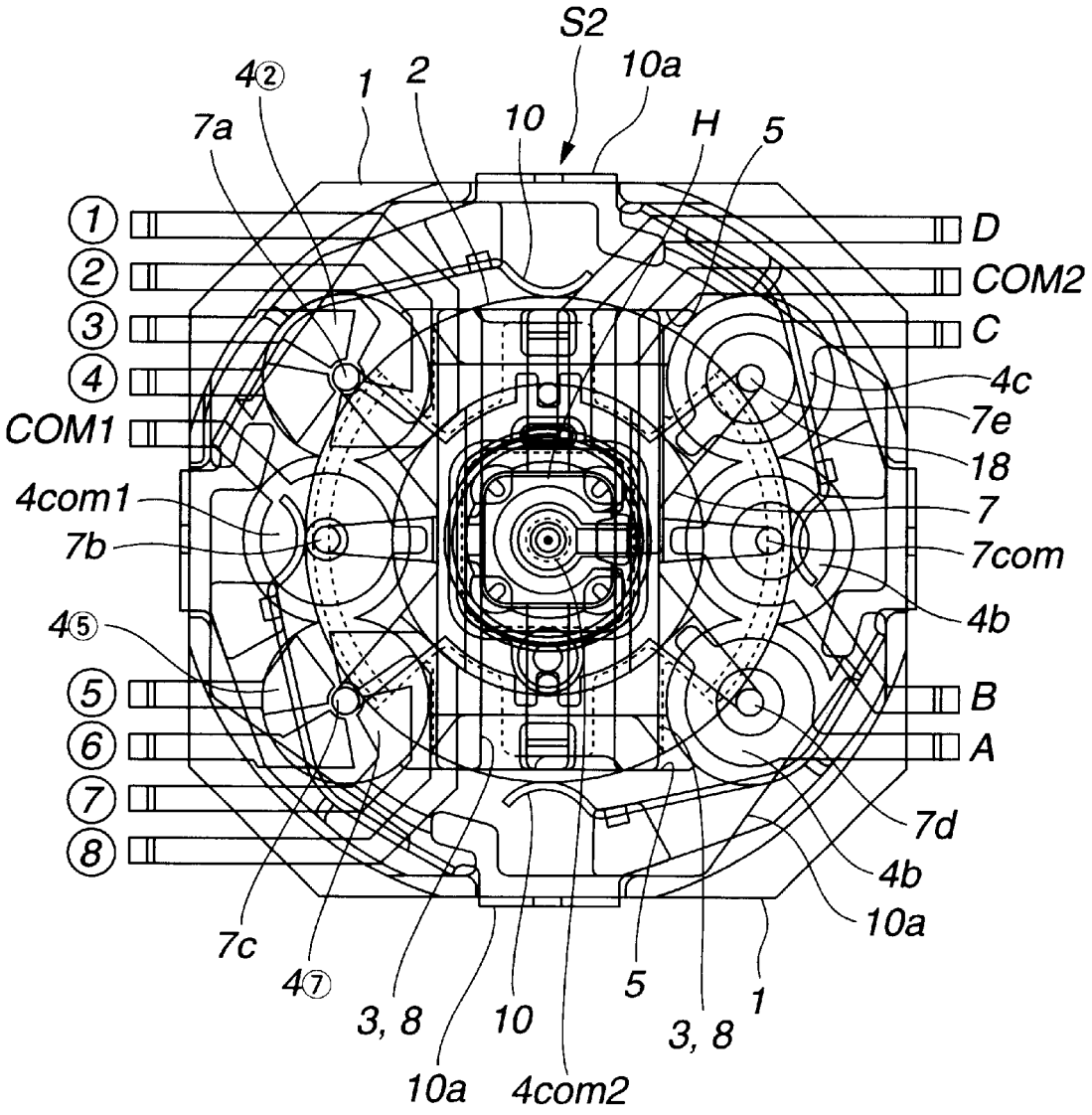
FIG. 12 is a front see-through view illustrating the structure of the slide switch of FIG. 11.
Figure 13:
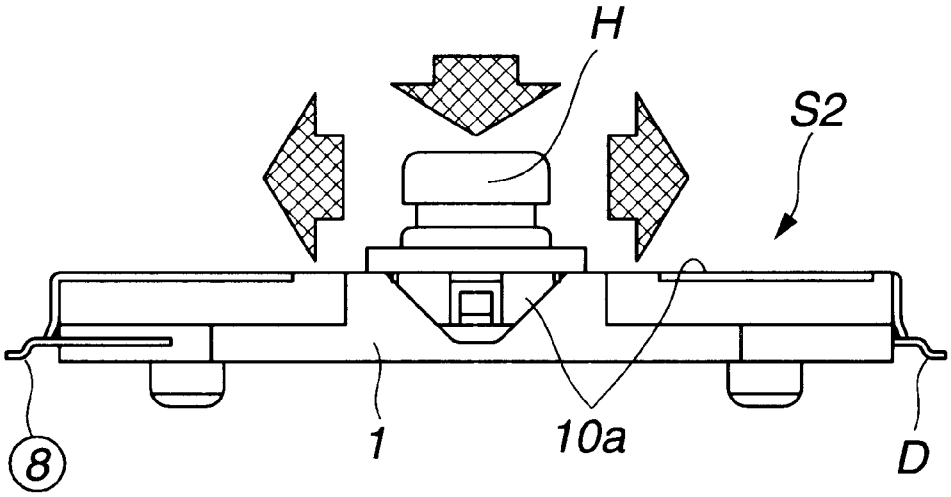
FIG. 13 is a view illustrating the base of the slide switch of FIG. 11.
Figure 14:
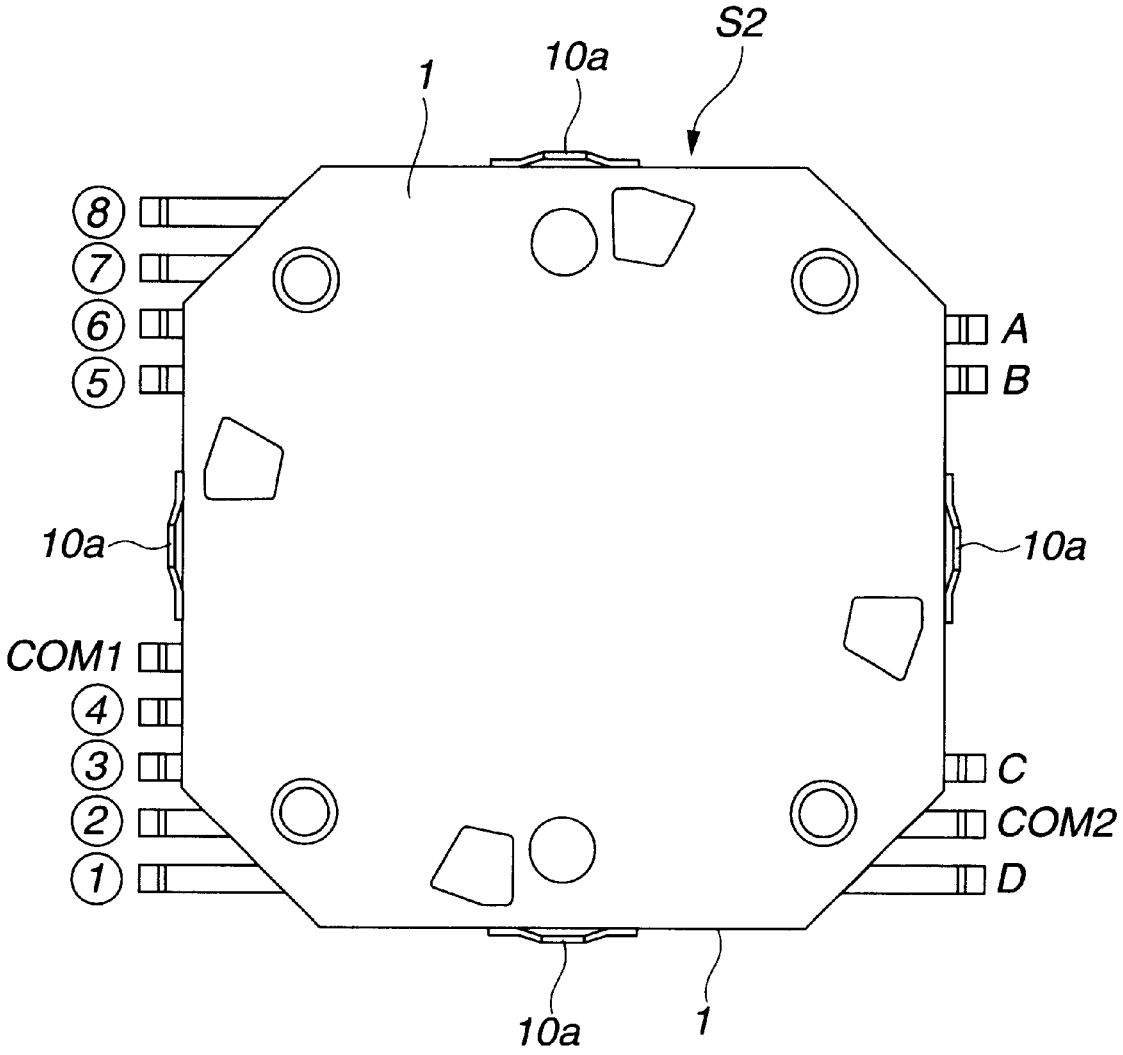
FIG. 14 is a bottom view illustrating the slide switch of FIG. 11.
Figure 15:
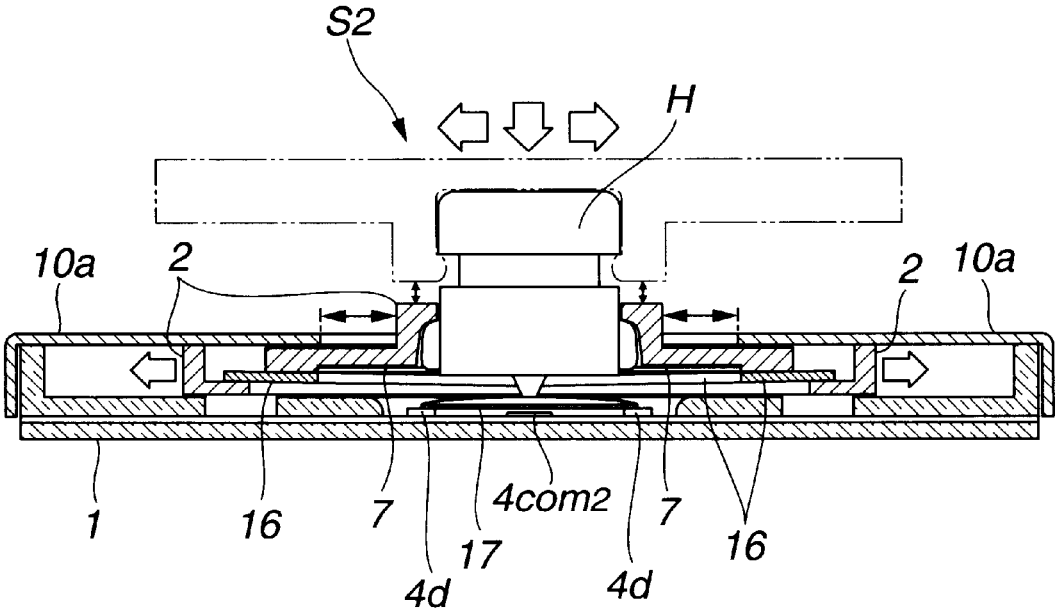
FIG. 15 is an enlarged cross-sectional view taken in the direction of the arrows along the line I—I of FIG. 11.
Figure 16:
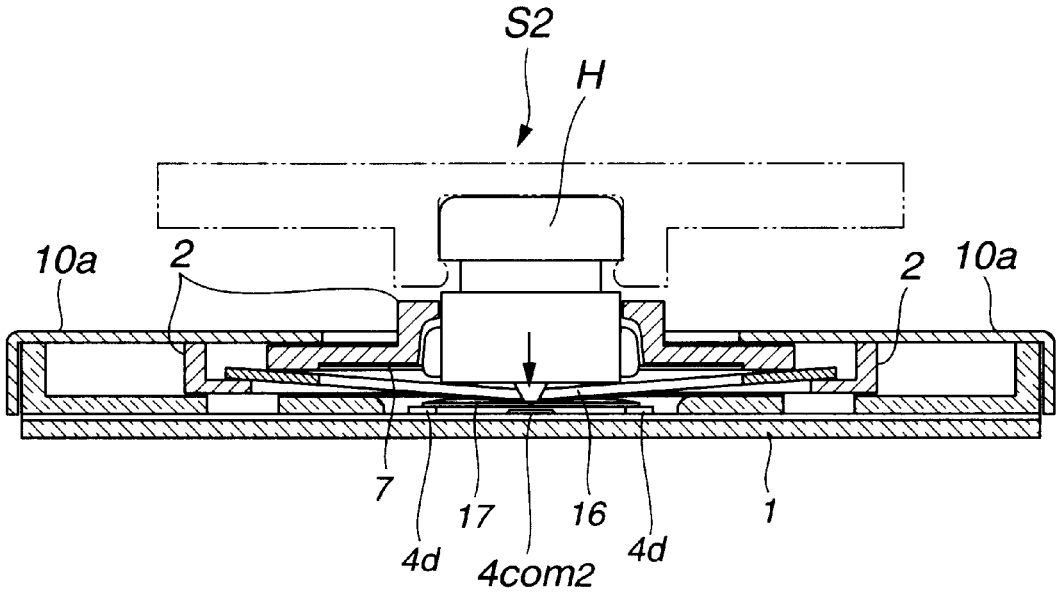
FIG. 16 is an explanatory view illustrating the push button/operation knob of FIG. 15, which is pushed down.
Figure 33:
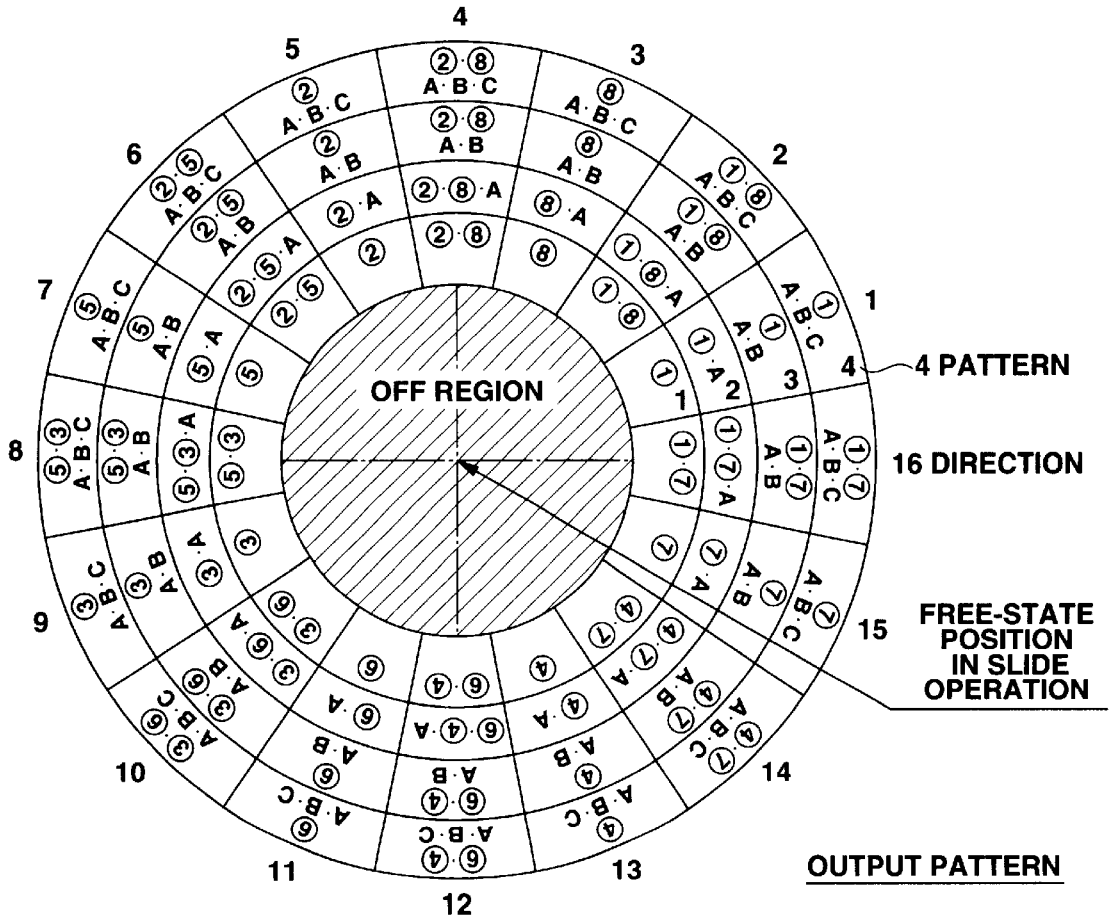
FIG. 33 is a diagram illustrating an output pattern (64 patterns=16 directions×4 patterns)
Figure 34:
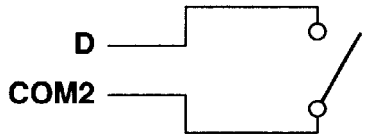
FIG. 34 shows a center push circuit using a push button/operation knob.
Figure 35:
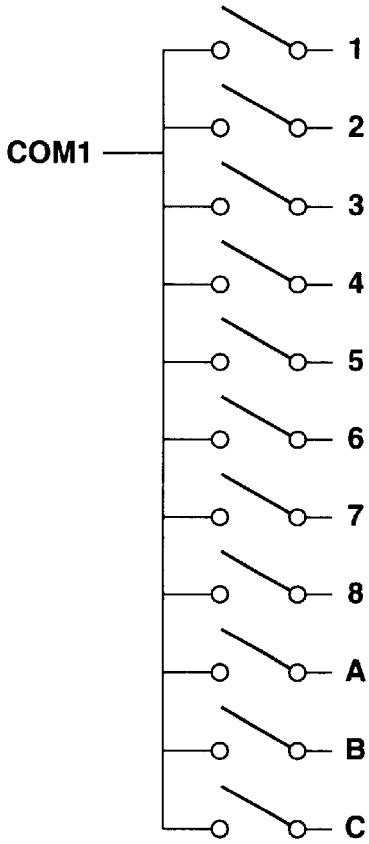
FIG. 35 shows a circuit diagram of the slider.

For example, FIG. 12 shows 72 patterns (=6×12). FIG. 33 shows 64 patterns (=14 slide directions×4 patterns).

In the slider 2*a*, the hole 15 for accepting the push button/operation knob H is formed in the center of the upper surface of the slider body 2*a*. The upper portion of the push button/operation knob H protrudes from the hole 15 by a set length and can move vertically by the set length. The return resilient plate 16 is suspended over the lower surface of the push button/operation knob H, whereby the resilient force returns the push button/operation knob H to its original position.

A diaphragm-type, movable contact spring disk 17 is inserted between the lower surface of the push-button/operation knob H and the stationary contacts exposed at the center P1 of the base 1. With the center P2 of the slider 2 and the center P1 of the base aligned together, and with the push button/operation knob H depressed, the lower surface thereof deforms the center of the movable contact spring disk 17. Thus, the movable contact spring disk 17 makes contact with the stationary contact 4*com*2 (see FIGS. 15 and 16).

Function of the Slide Switch S1

Figure 2:
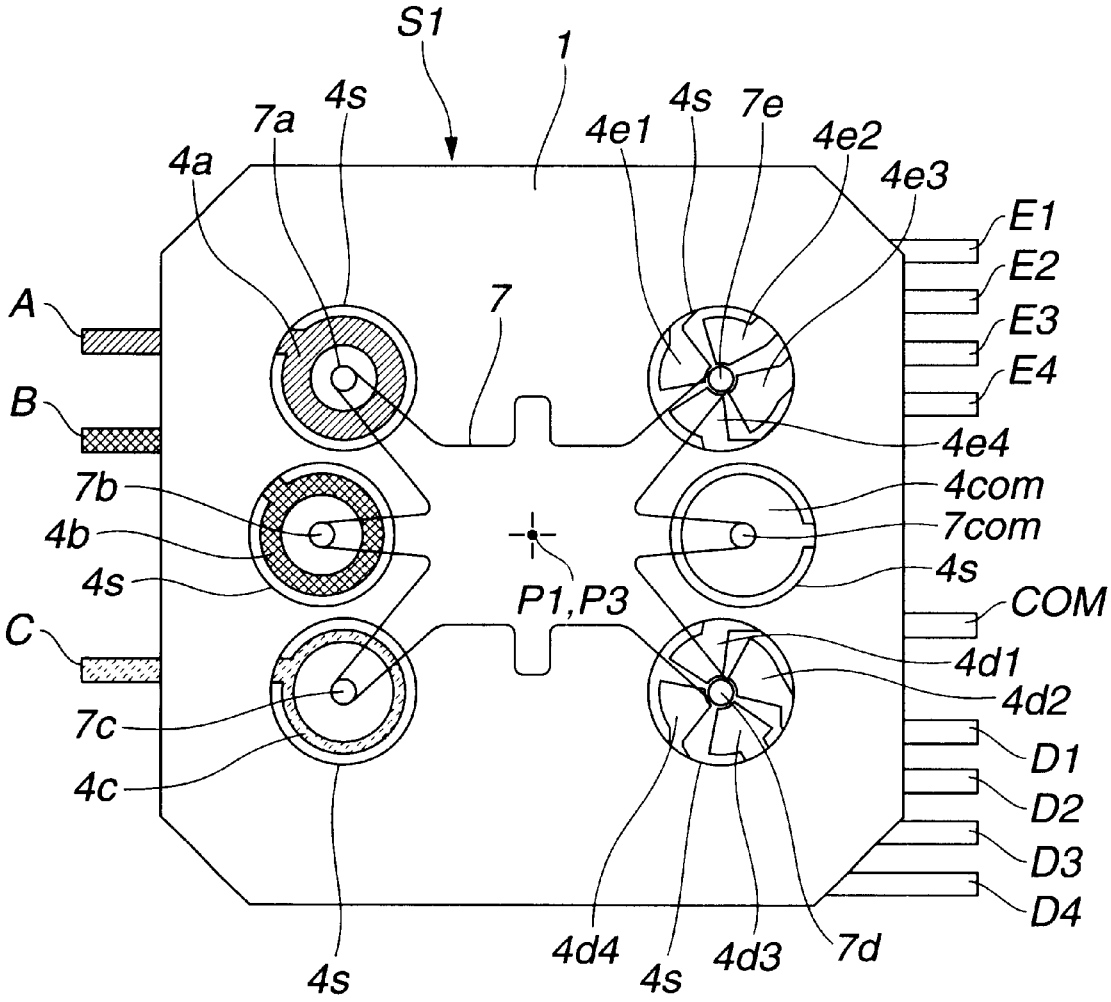
FIG. 2 is an explanatory view illustrating the function and the normal state (where the center of a base matches with the center of a slider) of the slider shown in FIG. 1.

As shown in FIG. 2, the center P1 of the base is aligned with the center P2 of the slider and the only the contact 7*com* of the movable contact spring piece 7 is in contact with the stationary contact 4*com*. Other contacts 7*a*, 7*b*, 7*c*, 7*d* and 7*e* are neutral (in non-contact).

Figure 3:
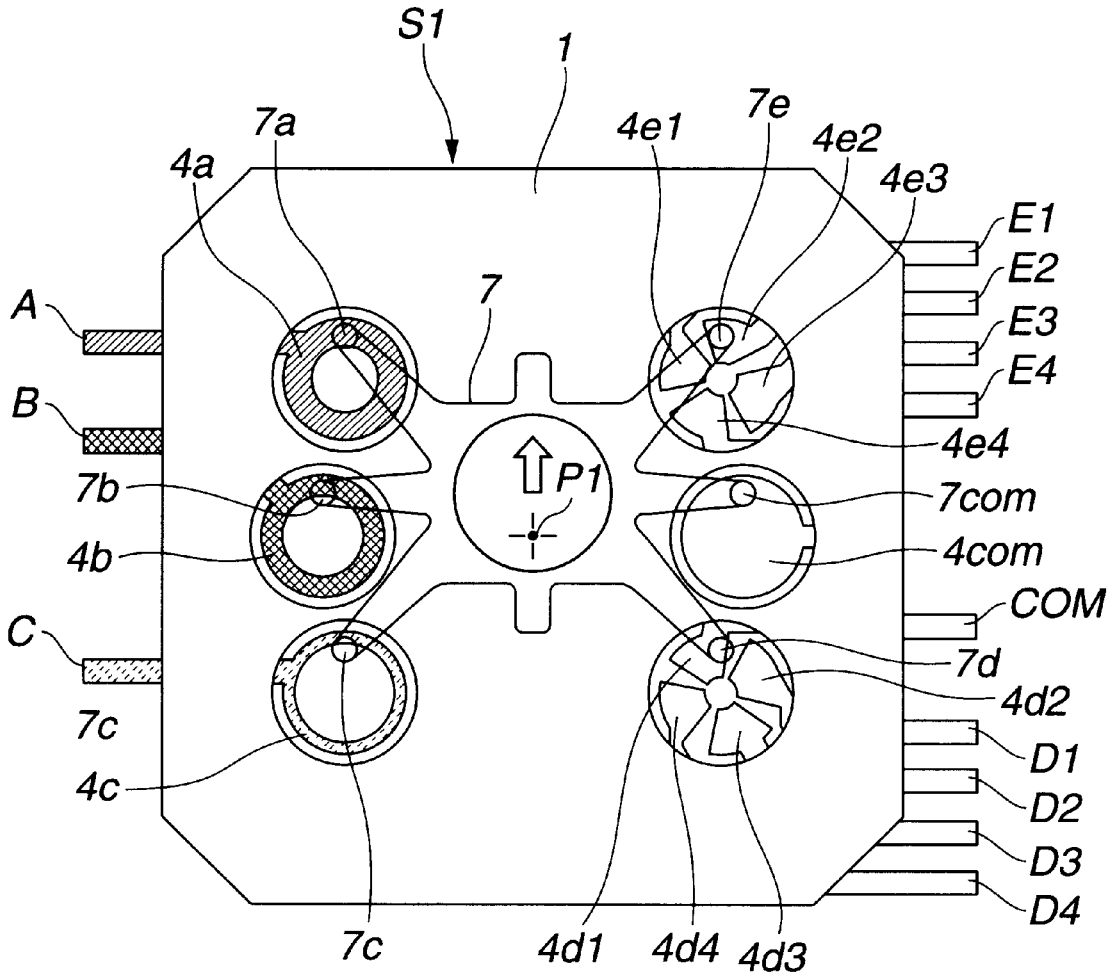
FIG. 3 is an explanatory view illustrating the function of the slide switch of FIG. 1, where the slider moves in the positive direction of the Y axis from the state shown in FIG. 2.

As shown in FIGS. 1 and 3, the operation portion 6, slides the slider 2 against the resilient force of the resilient return member 10 and from the center point P1 in the positive direction of the X axis until the slider comes in contact with the stop 9. Thus, the movable contact spring piece 7 moves together with the slider 2. Finally, while the contact 4*com* is in contact with the contact 7*com*, the contacts 4*a* and 7*a* are connected together, the contacts 4*b* and 7*b* are connected together, the contacts 4*c* and 7*c* are connected together, the contacts 4*d* 1 and 7*d* are connected together, and the contacts 4*e*2 and 7*e* are connected together.

Figure 4:
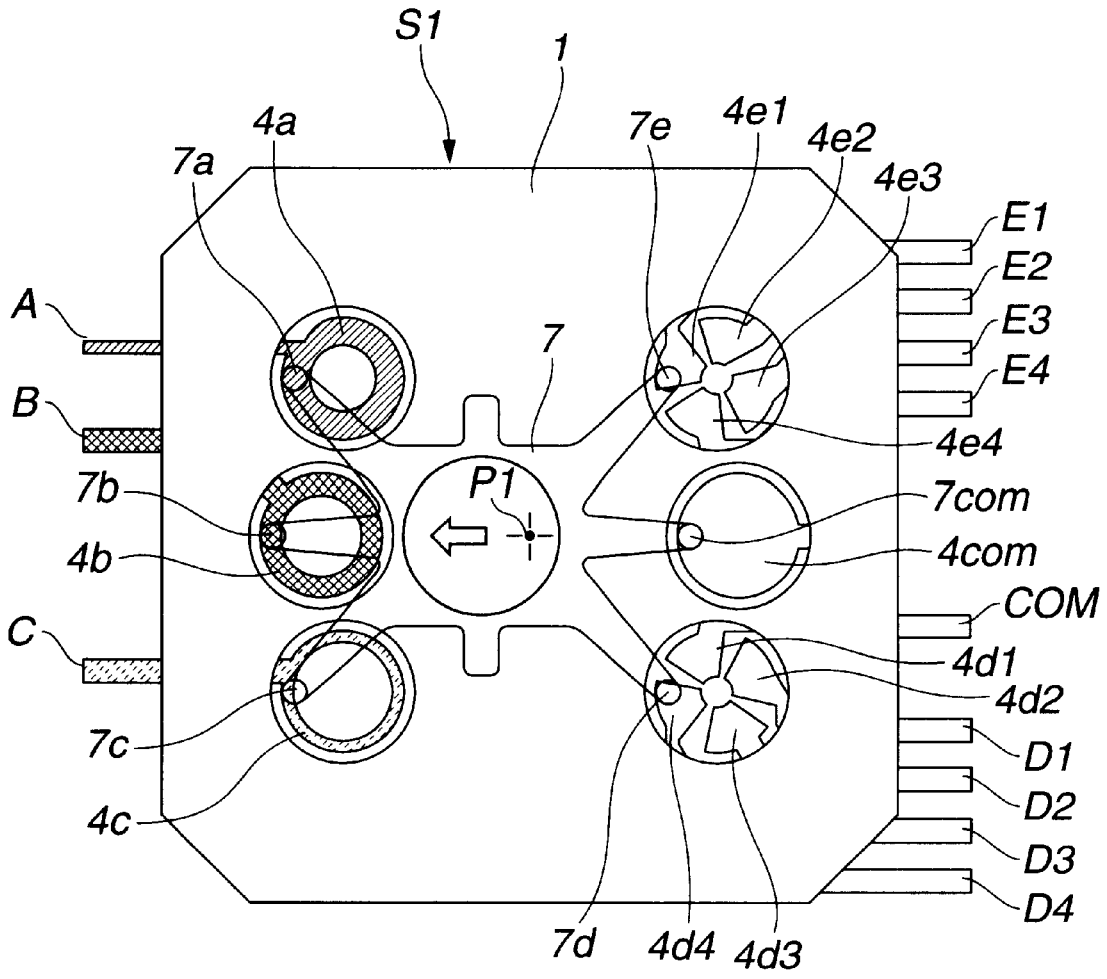
FIG. 4 is an explanatory view illustrating the function of the slide switch of FIG. 1, where the slider moves in the negative direction of the X axis from the state shown in FIG. 2.

Moreover, the status shown in FIG. 2 changes the status shown in FIG. 4. That is, the operation portion 6 slides the slider 2 from the center point P1, in the negative direction of the X axis, and the slider 2 comes in contact with the stop 9, in opposition to the resilient force of the resilient return member 10. Thus, the movable contact spring piece 7 moves together with the slider 2. Finally, while the contact 4*com* is in contact with the contact 7*com*; the contacts 4*a* and 7*a* are connected together; the contacts 4*b* and 7*b* are connected together; the contacts 4*c* and 7*c* are connected together; the contacts 4*d*4 and 7*d* are connected together; and the contacts 4*e*1 and 7*e* are connected together.

Similarly, the slider 2 slides from the center point P1 in the positive or negative direction of the X and Y axes, or horizontally and vertically so that the contact 7*a* of the movable contact spring piece 7 is connected or disconnected to/from the stationary contact 4*a*.

The slider 2 can slide vertically or horizontally (in four directions), or in oblique directions (e.g. 6, 8, 16 and 32 directions) at given angles with respect to the center point (however, it cannot rotate about the center point). Hence, the slide switch S1 can implement various switching functions, mode switching functions, and electrical functions where movable contacts are connected or disconnected to/from the stationary contacts.

Function of the Slide Switch S2

The slide switch S2 differs from the slide switch S1 in the function of the button/operation knob H.

When the button/operation knob H is depressed, the center of the diaphragm-type movable spring disk 17, inserted between the lower surface of the push button/operation knob H and the stationary contact 4*com*2 exposed in the center P1 of the base, 1 is deformed. Thus, the push button/operation knob H is contacted to the stationary contact 4*com*2 (in ON state).

When the push button/operation knob H is released, it returns to its original position by means of the resilient force of the return resilient plate 16. As a result, the movable contact spring disk 17 is restored, so as to be separated from the stationary contact 4*com*2 (in OFF state).

In the above operation, the center point P2 of the slider 2 is aligned with the center point P1 of the base 1 and the push button/operation knob H merely moves vertically along the length of the movable contact spring piece 7. For that reason, all the movable contacts of the movable contact spring piece 7 and the stationary contacts, except the stationary contact 4*com*2, remain an OFF state.

In this embodiment, the slide switch has three basic components, that is, a base, a slider and a sliding bridge. Hence, the slide switch can be easily fabricated using a small number of components. This enables miniaturization and cost reduction of the slide switch.

According to the present invention, two guide grooves are formed in parallel on the base and on the slider. The sliding bridge has two upper bridges and two lower bridges, each arranged in parallel. The upper bridges are fitted in the two parallel grooves of the slider and the lower bridges are fitted in the two parallel grooves of the base. In such a structure, the slider can move freely with respect to the base vertically or horizontally (in four directions), or in oblique directions at given angles (e.g. 6, 8, 16, or 32 directions).

Particularly, the slider can move smoothly and with high precision in a desired direction, without any torsion, backlash, or rotational deviation (failure in rotation).

These effects suggest that the function of the mouse for a computer, which has two rotational encoders for the X- and Y-axis directions of a ball, can be obtained.

The stationary contacts of the base and the contacts of the movable contact spring piece 7 of the slider can be designed in accordance with the relationships between mutual directions and in accordance with the movement of the slider.

Moreover, 72 output patterns (or switching functions) can be obtained corresponding to the product 6 moveable contacts and 12 stationary contacts.

Moreover, when the shape and area of a stationary contact is changed, the number of output patterns and the modes thereof can be changed.

The above mentioned features allow the slide switch to be used for mode switching functions and an electrical functions where one or more movable contacts are connected or disconnected to/from one or more stationary contacts.

In the center of each stationary contact there is a circular OFF area, and as such connections between each stationary contact and each movable contact are performed uniformly and accurately at the beginning of switching, without erroneous operation and variations.

Slide-type Photoelectric Converter

Photoelectric conversion elements (including light emitting elements or light receiving elements) are arranged at a plurality of positions on the base, on which two guide grooves of a set length are formed in parallel and in the X- or Y-axis direction. On the upper surface of the slider, a strip of arbitrary shape, e.g. circular, acts as an operation portion.

The slider includes an upper surface of a strip formed in a given shape (e.g. a circular shape) acting as an operation portion. The slider has two guide grooves of a set length, formed in parallel and in the X- or Y-axis direction on the upper surface thereof. Moreover, the slider has photoelectric conversion elements including light emitting elements or light receiving elements at a plurality of positions thereon.

The sliding bridge is formed by assembling two lower parallel bridges fitted along the two guide grooves on the base; and lower parallel bridges fitted along the two guide grooves on the slider. The sliding bridge is formed in a crossing, square, or rectangular frame.

The two lower parallel bridges of the sliding bridge, are fitted along the two parallel guide grooves of the base surface. The two upper parallel bridges of the sliding bridge are fitted along the two parallel guide grooves in the lower surface of the slider. With the sliding bridge inserted between the base surface and the lower surface of the slider, the slider can slide in a desired direction on the base, for example, vertically, horizontally, or in oblique directions at given angles. Each light emitting element or each light receiving element on the base are disposed in opposition to each light emitting element or each light receiving element on the slider.

In the slide-type photoelectric converter, the slider moves in a desired direction by a set distance to confront a target light emitting element with a target light receiving element. Thus, photoelectric conversion is performed between the light emitting element and the light receiving element.

The photoelectric conversion element is used to convert light energy to electrical energy. The light receiving element may, for example, a light emitting diode (such as a GaP element and a GaAs element). Moreover, the light receiving element may be, for example, a photodiode or an EL panel.

Moreover, the light receiving element may be an element of utilizing a change resistance of a semiconductor, for example, a CdS photocell and an element of utilizing a change in resistance of a PN junction, for example, a photo diode, a photo transistor, and a photo silicon controlled rectifier.

In the slide-type photoelectric converter, photoelectric conversion elements, each including a light emitting element and a light receiving element, are disposed at a plurality of positions on the base or the slider. Whereby, the slider moves in a desired direction along the base. Each light emitting element or light receiving element of the base is disposed in opposition to each light receiving element or light emitting element of the slider. The slider moves in a desired direction by a set length in such a way that a light emitting element and a light receiving element confront each other. Thus, photoelectric conversion between the light emitting diode and the light receiving element is performed.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A slide switch comprising:

a base including a plurality of patterned spaces, on which one or more stationary contacts of an arbitrary shape are provided; and a slider having a slider body mounted on said base, said slider including a movable contact spring piece from which a plurality of contact spring pieces with at least one contact protrudes;

said slider having two upper sliding bridges arranged in parallel and fitted into two guide grooves arranged in parallel on said base; and two lower sliding bridges arranged in parallel and fitted into two guide grooves arranged in parallel on said slider, whereby said slider is free to move in a desired direction;

wherein, at least one of said contacts of at least one of said movable contact spring pieces of said slider can slide in a desired direction, and be connected or disconnected to/from a target stationary contact, a switching function, a mode switching function, or an electrical function where one or more movable contacts and one or more stationary contacts are connected or disconnected is performed.

2. The slide switch defined in claim 1, wherein the base including the plurality of patterned spaces of arbitrary shape in which each stationary contact is formed on a notional circular path of a set radius with a center point on a surface of said base, at least one stationary contact of an arbitrary pattern circuit being exposed and formed on each of the said patterned spaces, a terminal for at least one said stationary contact protrudes out from said base, two guide grooves of a set length being formed in parallel on the surface and formed in the X or Y axis direction to be symmetric about the center point; said base having resilient return means arranged around a notional position of the slider on the surface at regular intervals; said base having stops around the notional position of the slider on the surface at the regular intervals; the slider having an operation portion being an upper surface of said slider body in a circular, polygonal, or square plate, fan-like raised portions being formed at positions symmetrically about a center point of a center hole on a lower surface of said slider body, the two guide grooves of a set length being formed respectively on said raised portions and in parallel in the Y or X axis direction so as to be symmetric about the center point, said slider having the movable contact spring piece with the contact spring pieces protruding around a center hole of a resilient plate, said movable contact spring piece being integrally mounted to a lower portion on the lower surface of the slider body while a center point of said slider body is aligned with the center point of said movable contact spring piece; the sliding bridge formed of the two lower bridges and the two upper bridges, integrally built in a cross, square, or rectangular shape, said two lower bridges being rectangular strips arranged in parallel which are slidably fixed along said two parallel guide grooves in said base, said two upper bridges being rectangular strips arranged in parallel which are slidably fixed along said two parallel guide grooves in said slider; wherein, said two parallel lower bridges of said sliding bridge are fitted in said two parallel guide grooves in the surface of said base; said two parallel upper bridges of said sliding bridge are fitted in said two parallel guide grooves in the lower surface of said slider; said sliding bridge is inserted between the surface of said base and the lower surface of said slider body; said slider confronts said base so as to be free to slide in a desired direction; resilient return means are in contact with and arranged around said slider at regular intervals while a resilient force maintains alignment between the center point of said base and the center point of said slider; each of said stationary contacts of said base and each of said movable contacts of said movable contact spring piece of said slider are placed so as to confront each other; wherein, when said slider slides a set distance in a desired direction from the center point, e.g. to the position where said slider comes in contact with said stopper, and returns toward the center point by means of said resilient return member, a movable contact of said movable contact spring piece is connected or disconnected to/from a desired stationary contact, whereby a switching function, mode switching function, or other electrical function, where the movable contact is connected or disconnected to/from said stationary contacts is performed.

3. The slide switch as defined in claim 1, wherein said resilient return member comprises means for resiliently returning said slider from a shifted position toward the center point, said resilient return member being one of selected from the group of a leaf spring, the leaf spring extendably mounted around a metal cover plate, a coil spring, and a conical spring, as well as an elastic member such as natural rubber or synthetic rubber.

4. The slide switch defined in claim 1, wherein said slider body of said slider is formed in an arbitrary shape; and wherein said movable contact spring piece mounted to said slider body has contact spring piece protruding radially or at equal or unequal angles around a resilient plate, said resilient plate being formed in an arbitrary shape, said contacts and stationary contacts being disposed so as to confront each other respectively.

5. The slide switch defined in claim 1, wherein said slider body of said slider is formed in an arbitrary shape; and wherein said movable contact spring piece mounted to said slider body has plural contact spring pieces protruding radially and at right and left set angles with respect to the center of the center hole of the resilient plate, said resilient plate being formed in an arbitrary shape, portions of said pattern circuit being stationary contacts exposed on the upper surface of said base, the center point of each of said stationary contacts confronting the center point of each of the movable contacts of said contact spring piece, each of said stationary contacts having a center area acting as an OFF area and a peripheral area acting as an ON area, each of said stationary contacts being formed in an arbitrary pattern; and wherein when the center of said slider, the center of said movable contact spring piece, and the center of said base are aligned, said movable contacts of said movable contact spring piece are respectively positioned at the OFF areas of the corresponding stationary contacts (all OFF state), and when said slider slides a set distance in a desired direction, said movable contacts are connected to one or more stationary contacts (ON state), whereby output patterns (switching functions) corresponding to the product of the number of movable contacts and the number of stationary contacts are created.

6. The slide switch defined in claim 1, wherein said slider has an opening where a push button/operation knob is installed in the middle portion of the upper surface of said slider body, said push button/operation knob being inserted into said opening such that the upper portion thereof protrudes upward and moves vertically, a return resilient plate being suspended below the lower surface of said push button/operation knob so that resilient force causes said push button/operation knob pushed down to return to its original position, a diaphragm-type movable contact spring disk being inserted between the lower surface of said push button/operation knob and a stationary contact exposed in the center of said base, whereby when said push button/operation knob in the center of said slider is vertically pushed down, with the center of said slider and the center of said base aligned with each other, the lower surface of said push button/operation knob deforms the center of said movable contact spring disk to establish contact (ON) with said stationary contacts.

7. The slide switch defined in claim 1, wherein a sliding bridge comprises two lower bridges and two upper bridges, integrally built in a cross, square, or rectangular shape, said two lower bridges being rectangular strips arranged in parallel which are slidably fixed along said two parallel guide grooves in said base, said two upper bridges being rectangular strips arranged in parallel which are slidably fixed along said two parallel guide grooves in said slider; and wherein said two parallel lower bridges of said sliding bridge are fitted in said two parallel guide grooves in the surface of said base; said two parallel upper bridges of said sliding bridge are fitted in said two parallel guide grooves in the lower surface of said slider; and wherein, with said sliding bridge inserted between the surface of said base and the lower surface of said slider, said slider is provided to said base in such a way that said slider slides in the Y- or X-axis direction along the guide grooves running in the Y- or X-axis direction of said slider, slides in the X- or Y-axis direction along the guide grooves running in the X- or Y-axis direction of said base, or slides in a composite direction of the X and Y directions, whereby said slider universally slides in a desired direction.

8. A slide switch comprising:

a base having a plurality of patterned spaces of an arbitrary shape, and including at least one stationary contact of an arbitrary patterned circuit being exposed and formed on each of the said patterned spaces;

a terminal for at least one said stationary contact protrudes out from said base, two guide grooves of a set length being arranged in parallel on the surface and formed in the X or Y axis direction so as to be symmetric about the center point;

a slider having an operation portion being an upper surface of an arbitrarily shaped plate, said slider having a slider body on which two guide grooves of a set length arranged in parallel in the lower surface and formed in parallel in the Y or X axis direction so as to be symmetric to the center point on the lower surface; said slider having a movable contact spring piece with a plurality of contact spring pieces protruding around a resilient plate, said movable contact spring piece being integrally mounted on the lower surface of the slider body while the center point of said slider body is aligned with the center point of said movable contact spring piece; and a sliding bridge formed of two lower bridges and two upper bridges, integrally built in a cross, square, or rectangular shape, whereby said two lower bridges being rectangular strips arranged in parallel which are slidably fitted along said two parallel guide grooves in said base, said two upper bridges being rectangular strips arranged in parallel which are slidably fitted along said two parallel guide grooves in said slider;

wherein, said two parallel lower bridges of said sliding bridge are fitted in said two parallel guide grooves on the surface of said base; said two parallel upper bridges of said sliding bridge are fitted in said two parallel guide grooves in the lower surface of said slider; said sliding bridge is inserted between the surface of said base and the lower surface of said slider; said slider confronts said base so as to be free to slide in a desired direction; resilient return means are arranged around said slider while a resilient force maintains alignment between the center point of said base and the center point of said slider; each of said stationary contacts of said base and each of said contacts of said movable contact spring piece of said slider are placed so as to confront each other;

wherein, when said slider slides a set distance in a desired direction from the center point and returns toward the center point by means of said resilient return member, a movable contact of said movable contact spring piece is connected or disconnected to/from at least one of said stationary contacts, whereby a switching function, mode switching function, or other electrical function where one or more movable contacts are connected or disconnected to/from the at least one stationary contact is performed.

9. The slide switch defined in claim 8, wherein the base including the plurality of patterned spaces of arbitrary shape in which each said stationary contact is formed on a notional circular path of a set radius with a center point on a surface of said base, said at least one stationary contact of the arbitrary pattern circuit being exposed and formed on each of the said patterned spaces, the terminal for the at least one said stationary contact protrudes out from said base, the two guide grooves of a set length being formed in parallel on the surface and formed in the X or Y axis direction to be symmetric about the center point; said base having resilient return means arranged around a notional position of the slider on the surface at regular intervals; said base having stops around the notional position of the slider on the surface at regular intervals; the slider having an operation portion being the upper surface of said slider body in a circular, polygonal, or square plate, fan-like raised portions being formed at positions symmetrically about the center point of a center hole on the lower surface, two guide grooves of a set length being formed respectively on said raised portions and in parallel in the Y or X axis direction so as to be symmetric about the center point, said slider having the movable contact spring piece with the contact spring pieces protruding around the center hole of a resilient plate, said movable contact spring piece being integrally mounted to a lower portion on the lower surface of the slider body while the center point of said slider body is aligned with the center point of said movable contact spring piece; the sliding bridge formed of the two lower bridges and two upper bridges, integrally built in a cross, square, or rectangular shape, said two lower bridges being rectangular strips arranged in parallel which are slidably fixed along said two parallel guide grooves in said base, said two upper bridges being rectangular strips arranged in parallel which are slidably fixed along said two parallel guide grooves in said slider; wherein, said two parallel lower bridges of said sliding bridge are fitted in said two parallel guide grooves in the surface of said base; said two parallel upper bridges of said sliding bridge are fitted in said two parallel guide grooves in the lower surface of said slider; said sliding bridge is inserted between the surface of said base and the lower surface of said slider; said slider confronts said base so as to be free to slide in a desired direction; resilient return means are in contact with and arranged around said slider at regular intervals while a resilient force maintains alignment between the center point of said base and the center point of said slider; each of said stationary contacts of said base and each of said movable contacts of said movable contact spring piece of said slider are placed so as to confront each other; wherein, when said slider slides a set distance in a desired direction from the center point, e.g. to the position where said slider comes in contact with said stopper, and returns toward the center point by means of said resilient return member, a movable contact of said movable contact spring piece is connected or disconnected to/from the at least one stationary contact, whereby a switching function, mode switching function, or other electrical function, where a movable contact is connected or disconnected to/from said stationary contacts is performed.

10. The slide switch as defined in claim 8, wherein said resilient return member comprises means for resiliently returning said slider from a shifted position toward the center point, said resilient return member being one of selected from the group of a leaf spring, the leaf spring extendably mounted around a metal cover plate, a coil spring, and a conical spring, as well as an elastic member such as natural rubber or synthetic rubber.

11. The slide switch defined in claim 8, wherein said slider body of said slider is formed in an arbitrary shape; and wherein said movable contact spring piece mounted to said slider body has contact spring piece protruding radially or at equal or unequal angles around a resilient plate, said resilient plate being formed in an arbitrary shape, said contacts and stationary contacts being disposed so as to confront each other respectively.

12. The slide switch defined in claim 8, wherein the sliding bridge comprises the two lower bridges and the two upper bridges, integrally built in a cross, square, or rectangular shape, said two lower bridges being rectangular strips arranged in parallel which are slidably fixed along said two parallel guide grooves in said base, said two upper bridges being rectangular strips arranged in parallel which are slidably fixed along said two parallel guide grooves in said slider; and wherein said two parallel lower bridges of said sliding bridge are fitted in said two parallel guide grooves in the surface of said base; said two parallel upper bridges of said sliding bridge are fitted in said two parallel guide grooves in the lower surface of said slider; and wherein, with said sliding bridge inserted between the surface of said base and the lower surface of said slider, said slider is provided to said base in such a way that said slider slides in the Y- or X-axis direction along the guide grooves running in the Y- or X-axis direction of said slider, slides in the X- or Y-axis direction along the guide grooves running in the X- or Y-axis direction of said base, or slides in a composite direction of the X and Y directions, whereby said slider universally slides in a desired direction.

13. A slide switch comprising:

a base including a plurality of patterned spaces of arbitrary shape, and including at least one stationary contact of an arbitrary patterned circuit being exposed and formed on each of said patterned spaces, a terminal for at least one said stationary contact protruding from said base, two guide grooves of a set length being formed in parallel on the surface while being formed in the X or Y axis direction to be symmetrical about the center point, said base having resilient return means arranged around a notional position of a slider on the surface at regular intervals;

a slider having an opening where a push button/operation knob is installed in the middle portion of the upper surface of a slider body in a circular, polygonal, or square plate, said push button/operation knob being inserted into said opening such that the upper portion thereof protrudes upward and moves vertically and freely, fan-like raised portions being formed at positions symmetrical about the center point of the lower surface of said slider body, two guide grooves of a set length being formed respectively on said raised portions and in parallel in the Y or X axis direction to be symmetric about the center point, said slider having a movable contact spring piece with said contact spring pieces protruding around the center hole of a resilient plate, said movable contact spring piece being integrally mounted to a lower portion on the lower surface of the slider body while the center point of said slider body is aligned with the center point of said movable contact spring piece, a return resilient plate being suspended below the lower surface of said push button/operation knob so that when said push button/operation knob is pushed down, resilient force causes said push button/operation knob to return to its original position; and a sliding bridge formed of two lower bridges and two upper bridges, integrally built in a cross, square, or rectangular shape, said two lower bridges being rectangular strips arranged in parallel which are slidably fixed along said two parallel guide grooves in said base, said two upper bridges being rectangular strips arranged in parallel which are slidably fixed along said two parallel guide grooves in said slider; wherein, said two parallel lower bridges of said sliding bridge are fitted in said two parallel guide grooves in the surface of said base; said two parallel upper bridges of said sliding bridge are fitted in said two parallel guide grooves in the lower surface of said slider; said sliding bridge is inserted between the surface of said base and the lower surface of said slider; said slider confronts said base so as to be free to slide in a desired direction;

resilient return means are in contact with and arranged around said slider at regular intervals while a resilient force maintains alignment between the center point of said base and the center point of said slider;

a movable contact spring disk is inserted between a stationary contact at the center of said base and the center the lower surface of said push button/operation knob mounted on said slider; and each of said stationary contacts of said base and each of said movable contacts of said movable contact spring piece of said slider are placed so as to confront each other;

wherein, when said slider slides a set distance in a desired direction from the center point and returns toward the center point by means of said resilient return member, a movable contact of said movable contact spring piece is connected or disconnected to/from the at least one stationary contact or when said push button/operation knob is pushed down and said resilient plate restores, said movable contact spring disk is disconnected from a stationary contact at the center of said base, whereby a switching function, mode switching function, or other electrical function where one or more movable contacts are connected or disconnected to/from one or more said stationary contacts is performed.

14. The slide switch defined in claim 13, wherein said slider body of said slider is formed in an arbitrary shape; and wherein said movable contact spring piece mounted to said slider body has plural contact spring pieces protruding radially and at right and left set angles with respect to the center of the center hole of the resilient plate, said resilient plate being formed in an arbitrary shape, portions of said pattern circuit being stationary contacts exposed on the upper surface of said base, the center point of each of said stationary contacts confronting the center point of each of the movable contacts of said contact spring piece, each of said stationary contacts having a center area acting as an OFF area and a peripheral area acting as an ON area, each of said stationary contacts being formed in an arbitrary pattern; and wherein when the center of said slider, the center of said movable contact spring piece, and the center of said base are aligned, said movable contacts of said movable contact spring piece are respectively positioned at the OFF areas of the corresponding stationary contacts (all OFF state), and when said slider slides a set distance in a desired direction, said movable contacts are connected to one or more stationary contacts (ON state), whereby output patterns (switching functions) corresponding to the product of the number of movable contacts and the number of stationary contacts are created.

15. The slide switch defined in claim 13, wherein said slider has an opening where a push button/operation knob is installed in the middle portion of the upper surface of said slider body, said push button/operation knob being inserted into said opening such that the upper portion thereof protrudes upward and moves vertically, a return resilient plate being suspended below the lower surface of said push button/operation knob so that resilient force causes said push button/operation knob pushed down to return to its original position, a diaphragm-type movable contact spring disk being inserted between the lower surface of said push button/operation knob and a stationary contact exposed in the center of said base, whereby when said push button/operation knob in the center of said slider is vertically pushed down, with the center of said slider and the center of said base aligned with each other, the lower surface of said push button/operation knob deforms the center of said movable contact spring disk to establish contact (ON) with said stationary contacts.

16. The slide switch defined in claim 13, wherein the sliding bridge comprises the two lower bridges and the two upper bridges, integrally built in a cross, square, or rectangular shape, said two lower bridges being rectangular strips arranged in parallel which are slidably fixed along said two parallel guide grooves in said base, said two upper bridges being rectangular strips arranged in parallel which are slidably fixed along said two parallel guide grooves in said slider; and wherein said two parallel lower bridges of said sliding bridge are fitted in said two parallel guide grooves in the surface of said base; said two parallel upper bridges of said sliding bridge are fitted in said two parallel guide grooves in the lower surface of said slider; and wherein, with said sliding bridge inserted between the surface of said base and the lower surface of said slider, said slider is provided to said base in such a way that said slider slides in the Y- or X-axis direction along the guide grooves running in the Y- or X-axis direction of said slider, slides in the X- or Y-axis direction along the guide grooves running in the X- or Y-axis direction of said base, or slides in a composite direction of the X and Y directions, whereby said slider universally slides in a desired direction.

17. A slide mechanism comprising:

a base having a surface in which two guide grooves of a set length are formed in parallel in the X- or Y-axis direction;

a slider on which two grooves of a set length are formed in parallel in the Y- or X axis direction on the lower surface of a strip in arbitrary shape; and a sliding bridge formed of two lower bridges and two upper bridges, integrally built in a cross, square, or rectangular shape, said two lower bridges being rectangular strips arranged in parallel which are slidably fixed along said two parallel guide grooves in said base, said two upper bridges being rectangular strips arranged in parallel which are slidably fixed along said two parallel guide grooves in said slider;

wherein, said two parallel lower bridges of said sliding bridge are fitted in said two parallel guide grooves in the surface of said base; and said two parallel upper bridges of said sliding bridge are fitted in said two parallel guide grooves in the lower surface of said slider;

wherein, with said sliding bridge inserted between the surface of said base and the lower surface of said slider, said slider arbitrarily slides in a desired direction over said base.

* * * * *